US007007623B2

(12) United States Patent
Boatman et al.

(10) Patent No.: US 7,007,623 B2
(45) Date of Patent: Mar. 7, 2006

(54) RETRIEVAL AND CONNECTION SYSTEM FOR A DISCONNECTABLE MOORING YOKE

(75) Inventors: L. Terry Boatman, Houston, TX (US); Stephen P. Lindblade, Waller, TX (US); Jerry L. McCollum, deceased, late of Hempstead, TX (US); by Jane C. McCollum, legal representative, Hempstead, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/712,127

(22) Filed: Nov. 12, 2003

(65) Prior Publication Data

US 2004/0094082 A1 May 20, 2004

Related U.S. Application Data

(60) Provisional application No. 60/425,804, filed on Nov. 12, 2002.

(51) Int. Cl.
*B63B 21/00* (2006.01)

(52) U.S. Cl. ..... 114/230.15; 114/230.23; 114/230.26

(58) Field of Classification Search ..... 441/3–5; 114/230.12, 230.14, 230.26, 230.15, 230.2, 114/230.23
See application file for complete search history.

(56) References Cited

U.S. PATENT DOCUMENTS

| | | | |
|---|---|---|---|
| 2,882,536 | A | 4/1959 | Jordan |
| 2,895,300 | A | 7/1959 | Hayward |
| 3,155,069 | A | 11/1964 | Ross et al. |
| 3,354,479 | A | 11/1967 | Koppenol et al. |
| 3,380,091 | A | 4/1968 | Saurin et al. |
| 3,426,719 | A | 2/1969 | Mizell |
| 3,726,247 | A | 4/1973 | Dalzell |
| 3,783,816 | A | 1/1974 | de Chassy et al. |
| 3,899,990 | A | 8/1975 | Lecomte |
| 3,908,212 | A | 9/1975 | van Heijst |
| 4,029,039 | A | 6/1977 | van Heijst |
| 4,088,089 | A | 5/1978 | Flory |

(Continued)

FOREIGN PATENT DOCUMENTS

| | | |
|---|---|---|
| CA | 2216047 | 9/1996 |

(Continued)

OTHER PUBLICATIONS

Drawings showing a tower yoke system supplied for the Chinese National Oil Company by Sofec, Inc. in 1999.

*Primary Examiner*—Sherman Basinger
(74) *Attorney, Agent, or Firm*—Gary L. Bush, Esq.; Andrews Kurth LLP

(57) ABSTRACT

A mooring yoke and method for using same to connect or disconnect a shuttle vessel to a body, such as an LNG liquefaction and storage vessel (LNG/FPSO). The yoke is pivotably connected at one end to the LNG/FPSO. The other or tip end of the yoke includes a buoyant element and a male connector element to be received in a female receiver element carried by the shuttle vessel. A tension element is arranged and designed to run through the male connector element and to be clamped on the shuttle vessel. A yoke windlass, alternatively mounted on the yoke or the LNG/FPSO pulls on the tension element thereby pulling the tip end of the yoke out of the sea and the male connector element into the female receiver element. A locking mechanism selectively locks the male element to the female receiver.

14 Claims, 20 Drawing Sheets

U.S. PATENT DOCUMENTS

| | | | | | |
|---|---|---|---|---|---|
| 4,114,556 | A | | 9/1978 | Orndorff et al. | |
| 4,182,389 | A | | 1/1980 | Guillaume et al. | |
| 4,309,955 | A | | 1/1982 | Kentosh | |
| 4,351,260 | A | | 9/1982 | Tuson et al. | |
| 4,352,596 | A | | 10/1982 | Hammett | |
| 4,406,636 | A | | 9/1983 | van Heijst et al. | |
| 4,441,448 | A | | 4/1984 | Hillberg | |
| 4,490,121 | A | | 12/1984 | Coppens et al. | |
| 4,516,942 | A | | 5/1985 | Pedersen | |
| 4,530,302 | A | | 7/1985 | Pedersen | |
| 4,534,740 | A | | 8/1985 | Poldervaart | |
| 4,567,843 | A | * | 2/1986 | d'Hautefeuille | 114/230.14 |
| 4,568,295 | A | | 2/1986 | Poldervaart | |
| 4,665,856 | A | | 5/1987 | Pedersen | |
| 4,669,412 | A | | 6/1987 | Pollack | |
| 4,686,924 | A | | 8/1987 | Poldervaart et al. | |
| 4,735,167 | A | | 4/1988 | White et al. | |
| 4,741,716 | A | * | 5/1988 | Hasebe et al. | 441/4 |
| 4,784,079 | A | | 11/1988 | Poldervaart | |
| 4,825,797 | A | | 5/1989 | Poldervaart et al. | |
| 4,836,813 | A | | 6/1989 | Poldervaart | |
| 4,876,978 | A | * | 10/1989 | O'Nion et al. | 114/230.15 |
| 4,907,996 | A | | 3/1990 | Poldervaart | |
| 4,917,038 | A | | 4/1990 | Poldervaart et al. | |
| 5,816,183 | A | | 10/1998 | Braud et al. | |
| 6,244,920 | B1 | | 6/2001 | de Baan | |
| 2003/0226487 | A1 | * | 12/2003 | Boatman et al. | 114/230.15 |
| 2004/0025772 | A1 | * | 2/2004 | Boatman | 114/230.15 |
| 2004/0237868 | A1 | * | 12/2004 | Poldervaart et al. | 114/230.15 |
| 2004/0237869 | A1 | * | 12/2004 | Poldervaart et al. | 114/230.17 |

FOREIGN PATENT DOCUMENTS

| | | | |
|---|---|---|---|
| CA | 2216181 | | 9/1996 |
| EP | 0 049 549 | | 10/1981 |
| EP | 0096119 | | 12/1983 |
| EP | 0 947 464 | | 4/1998 |
| EP | 1 283 159 | A1 * | 2/2003 |
| EP | 1 308 384 | A2 * | 5/2003 |
| FR | 7808760 | | 3/1978 |
| GB | 2 019 800 | | 3/1979 |
| GB | 2043008 | | 10/1980 |

* cited by examiner

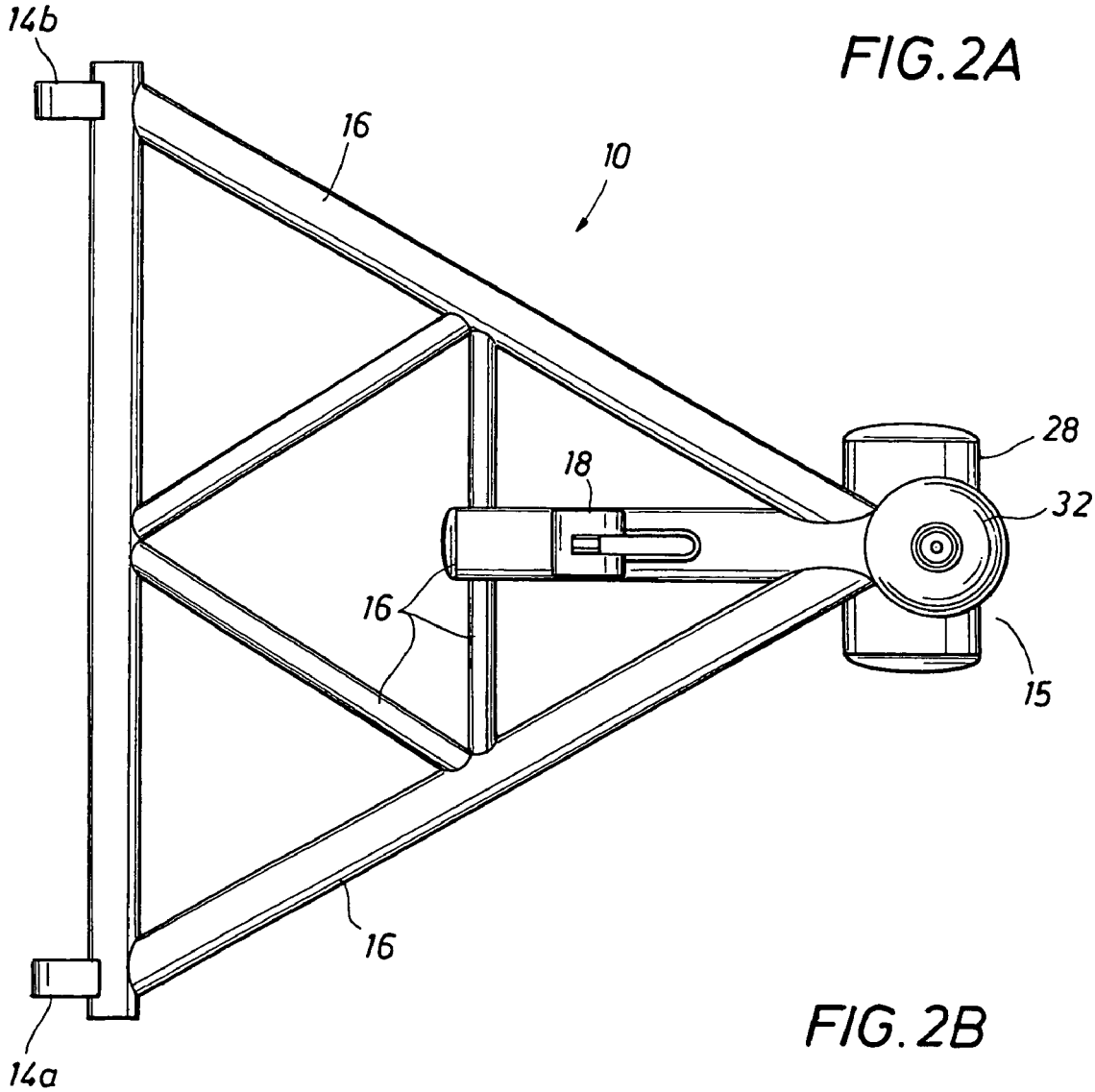
FIG. 2A
FIG. 2B
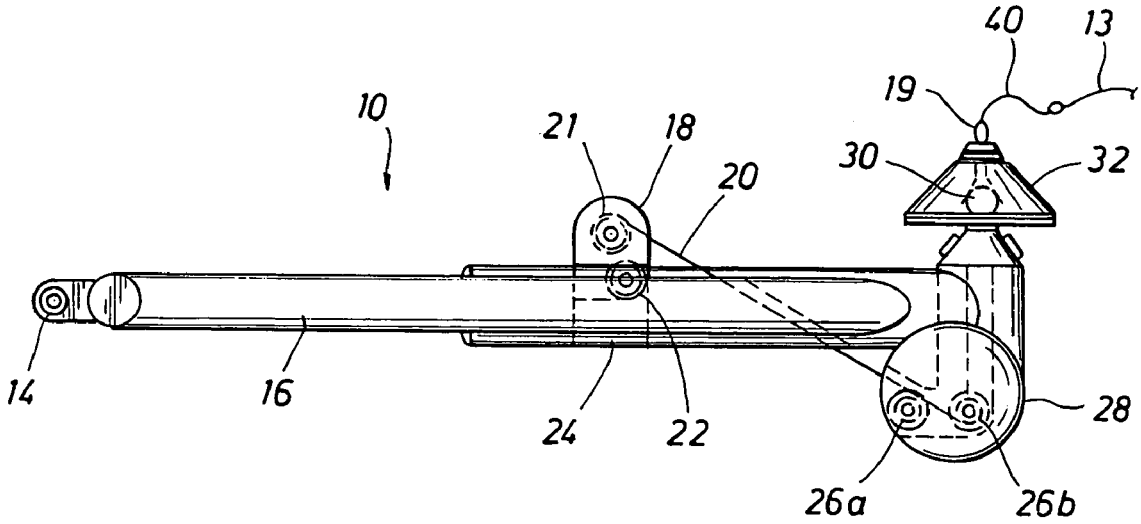

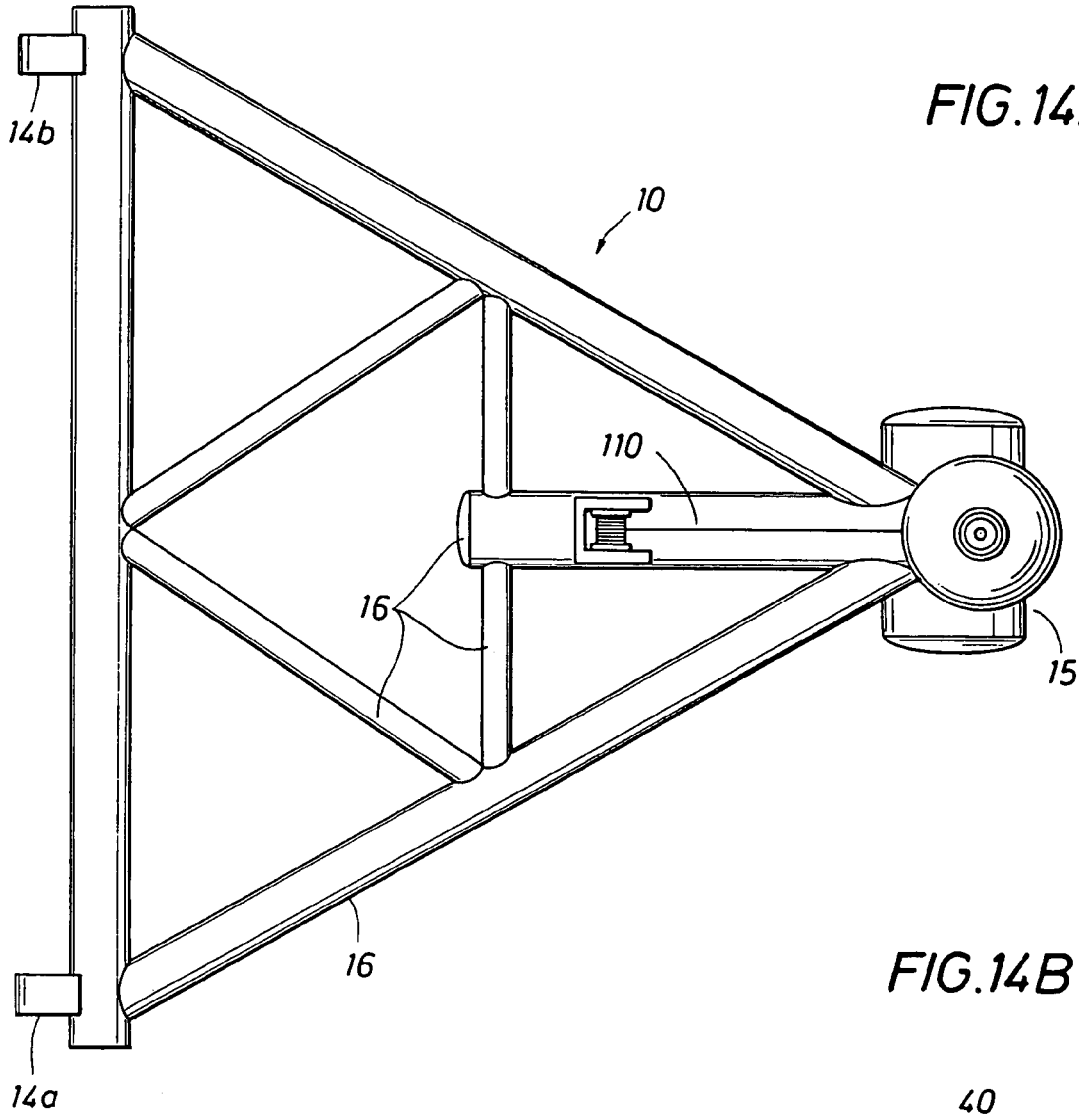
FIG.14A
FIG.14B
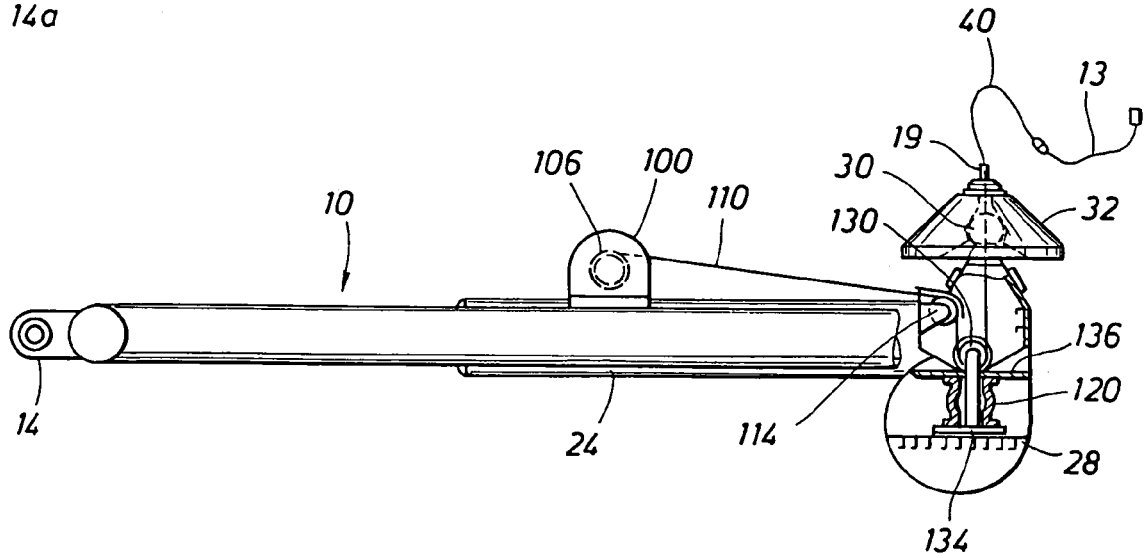

FIG.16A
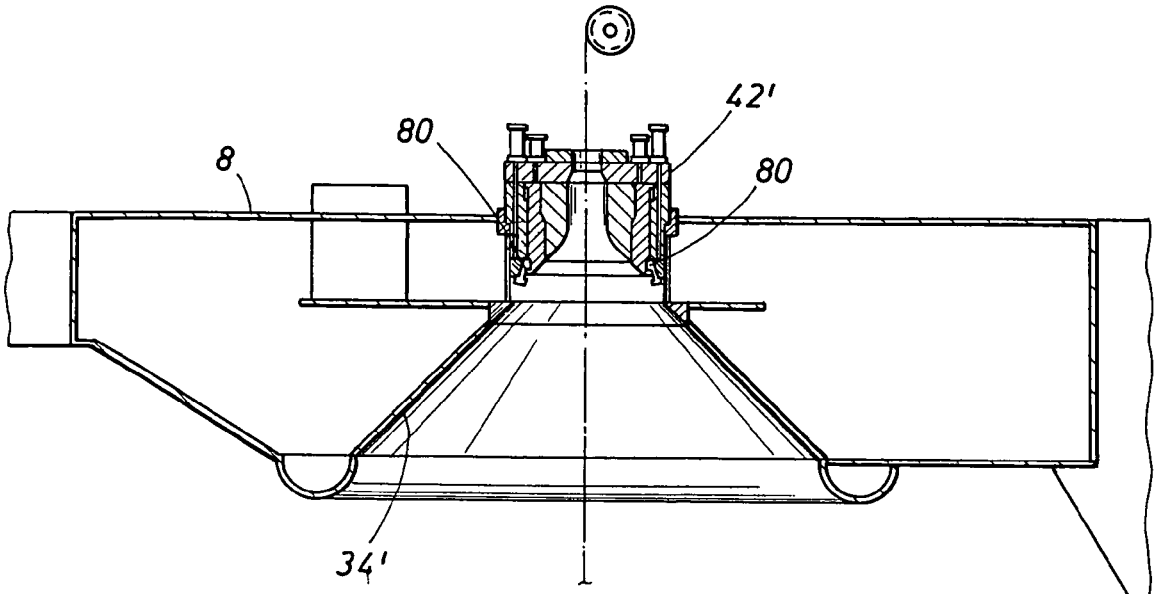
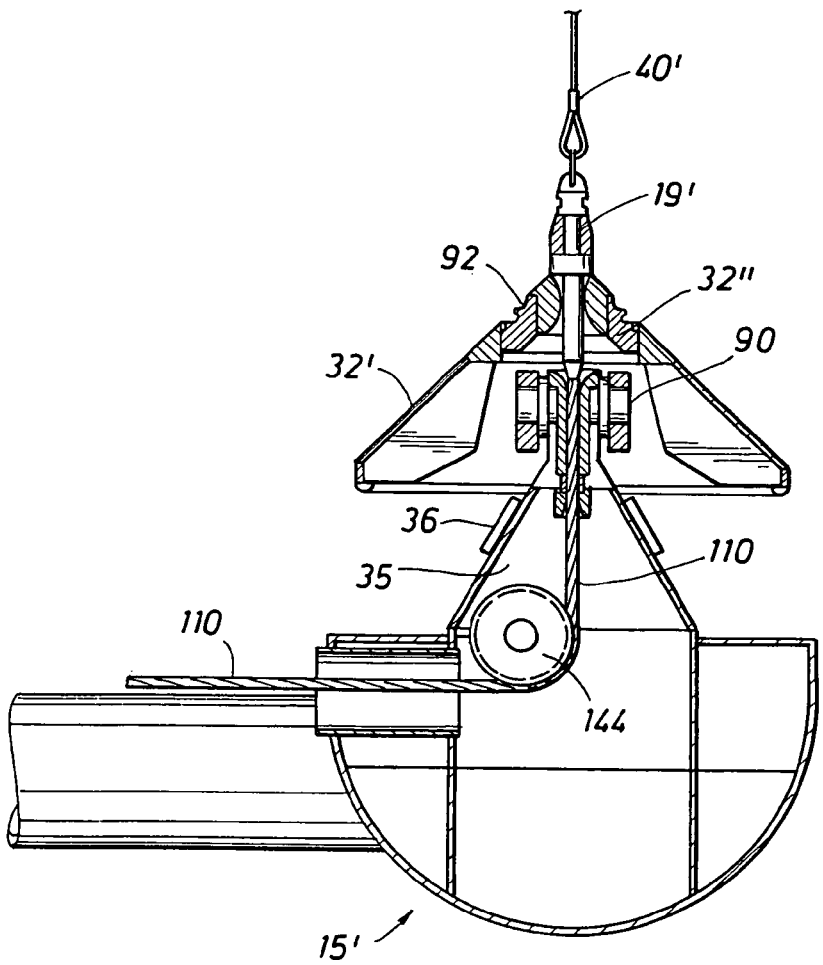
FIG.16B

RETRIEVAL AND CONNECTION SYSTEM FOR A DISCONNECTABLE MOORING YOKE

CROSS REFERENCE TO RELATED APPLICATION

This non-provisional application claims priority from U.S. provisional application 60/425,804 filed on Nov. 12, 2002.

BACKGROUND OF THE INVENTION

1. Field of the Invention

This invention relates generally to Floating Production Storage and Offloading vessels (FPSOs) including those for LNG liquefaction, production, and storage. In particular, this invention relates to tandem offloading of a permanently moored LNG liquefaction and storage vessel.

2. Description of Prior Art

Periodically LNG carrier vessels arrive at a FPSO with Liquified Natural Gas stored therein and load the liquefied gas for transport to distant ports. Highly reliable and safe temporary mooring equipment is required to mechanically connect the LNG carrier to the stern of the FPSO in offshore sea conditions while Liquified Natural Gas transfer occurs between the two vessels. The offshore energy industry requires apparatus to safely pull the LNG carrier vessel into position for mooring and to draw the yoke tip of the FPSO and the LNG carrier bow extension together and into controlled contact and mechanical connection and safe disconnection of the vessels.

IDENTIFICATION OF OBJECTS OF THE INVENTION

The primary objects of this invention are to:

a. Provide an arrangement for a yoke retrieval system that safely pulls the LNG carrier bow into proximity with the yoke tip of the FPSO with minimal assistance from auxiliary handling vessels during moderate sea states of about 3.5 meters significant wave height with cross winds and currents;

b. Provide an apparatus that lifts the floating yoke tip out of the water and guides the yoke tip into connecting position within the LNG carrier bow extension while large fluctuating pull-in chain loads occur with chain angles up to about 30 degrees from a horizontal plane;

c. Provide an apparatus that provides for frequent and reliable connection and disconnection of the yoke from the LNG carrier; and d. Provide a connection device that provides quick emergency disconnection of the yoke from the LNG carrier.

SUMMARY OF THE INVENTION

The objects identified above are incorporated in a mooring yoke and method of mooring a vessel to a body such as an LNG process vessel by connecting the yoke to the vessel. The yoke is pivoted at its broad end to the LNG process vessel. The tip of the yoke has a buoyant element so that the tip end of the yoke floats on the sea prior to mooring operations. A windlass is provided, on the mooring yoke itself or on the LNG process vessel, that pulls a chain or rope connected to a bow extension of the LNG carrier or shuttle vessel, thereby pulling the vessel and yoke toward each other. Ultimately, force pulling the chain or rope lifts the yoke tip and a self-aligning guide cone from the sea and upward into contact with a receiver for a mechanical connection.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which:

FIG. 2A is a plan view of the yoke of FIG. 1A and 1B;

FIG. 2B is a side elevation view of the yoke of FIG. 2A;

FIGS. 14A and 14B show a plan and side view respectively of an alternative arrangement for a yoke tip connector;

FIGS. 16A and 16B respectively illustrate details of the mating receiver on the bow extension of the LNG carrier vessel and a mating cone and yoke tip with a pull-in line passing through a U-joint of the mating cone;

DESCRIPTION OF PREFERRED EMBODIMENTS OF THE INVENTION

The preferred embodiments of the invention illustrated by reference to the drawings as indicated above, includes reference numbers to the various parts and elements. A summary of the names assigned to those parts and elements follows.

Figure 1A:
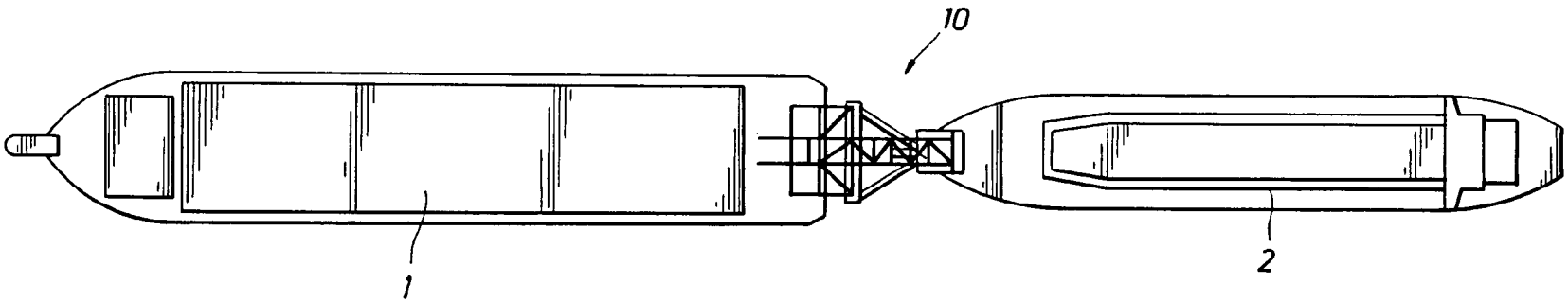
FIG. 1A is a plan view of a FPSO vessel and a yoke moored LNG carrier.
Figure 1B:
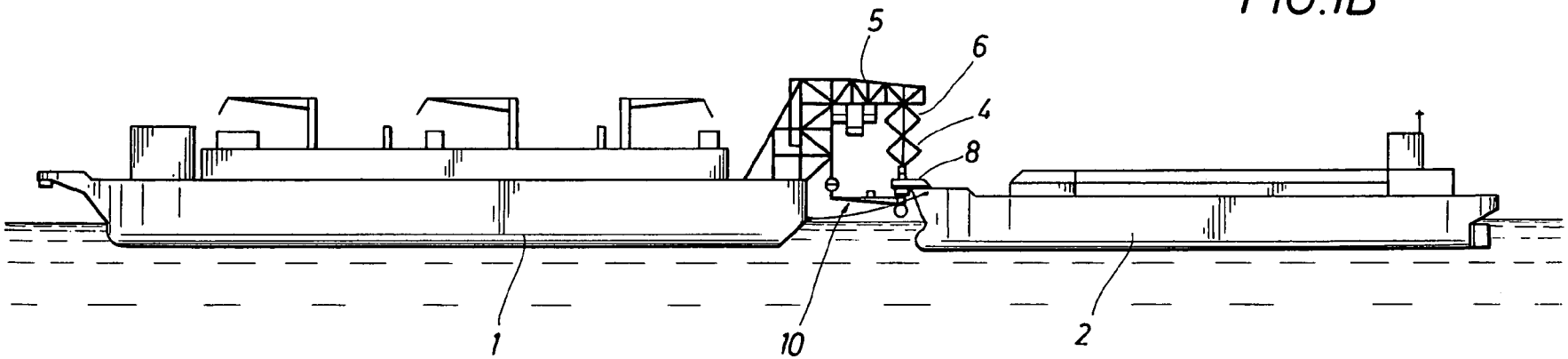
FIG. 1B is a side elevation view of the FPSO vessel and yoke moored LNG carrier.

1 FPSO vessel
2 LNG carrier vessel (LNGC)
3 Workboat
4 LNG transfer system
5 Support frame
6 Piping pantograph
8 Bow extension
9 Control room
10 Disconnectable mooring yoke
11*a*, 11*b* Mooring Winch
12*a*, 12*b* Hawser
13 Floating rope
14*a*, 14*b* Hinge joint
15 Yoke tip
16 Yoke frame
17 Messenger rope
18 Chain windlass
19 End fitting
20 Retrieval chain
21 Chain pocket wheel
22 Chain guide wheel
23 Electrical power cable
24 Chain locker
26*a*, 26*b* Chain guide wheel
28 Buoyant chamber
30 Three-axis flexible joint
32 Guide cone
32" Guide cone extension
33 Radius
34 Receiver
35 Pedestal
36 Elastomeric bumper
37 Connector in unlocked position
38 Connector in locked position
40 Pull-in rope
41 Rope sheave
42 Stopper
44 Shock absorber
46 Connector control panel
48 Winch
50 Service platform
52 Platform trolley
80 Dogs
82 Grooves
90 Two-axis gimbaled joint
92 Outer profile of guide cone extension
100 Rope winch
100' Rope winch
106 Winch drum
110 Rope
114 Fixed rope sheave
120 Elastomeric spring
130 Moveable rope sheave
134 Sheave frame
136 Support bracket FIGS. 1A and 1B illustrate FPSO vessel 1 with LNG carrier 2 connected in tandem by means of disconnectable mooring yoke 10. LNG transfer system 4 provides a transfer arrangement for transferring liquefied natural gas (LNG) from either vessel to the other. FPSO vessel 1 is one of several types of process vessels including a liquefaction process or a gas to liquids process. LNG transfer system 4 is shown as one application for this invention. The arrangements described herein are applicable to other mooring systems where it is necessary to connect a mooring yoke to a floating vessel in environmental conditions of sea states of about 3.5 meters significant wave height with cross winds and currents.

Figure 3:
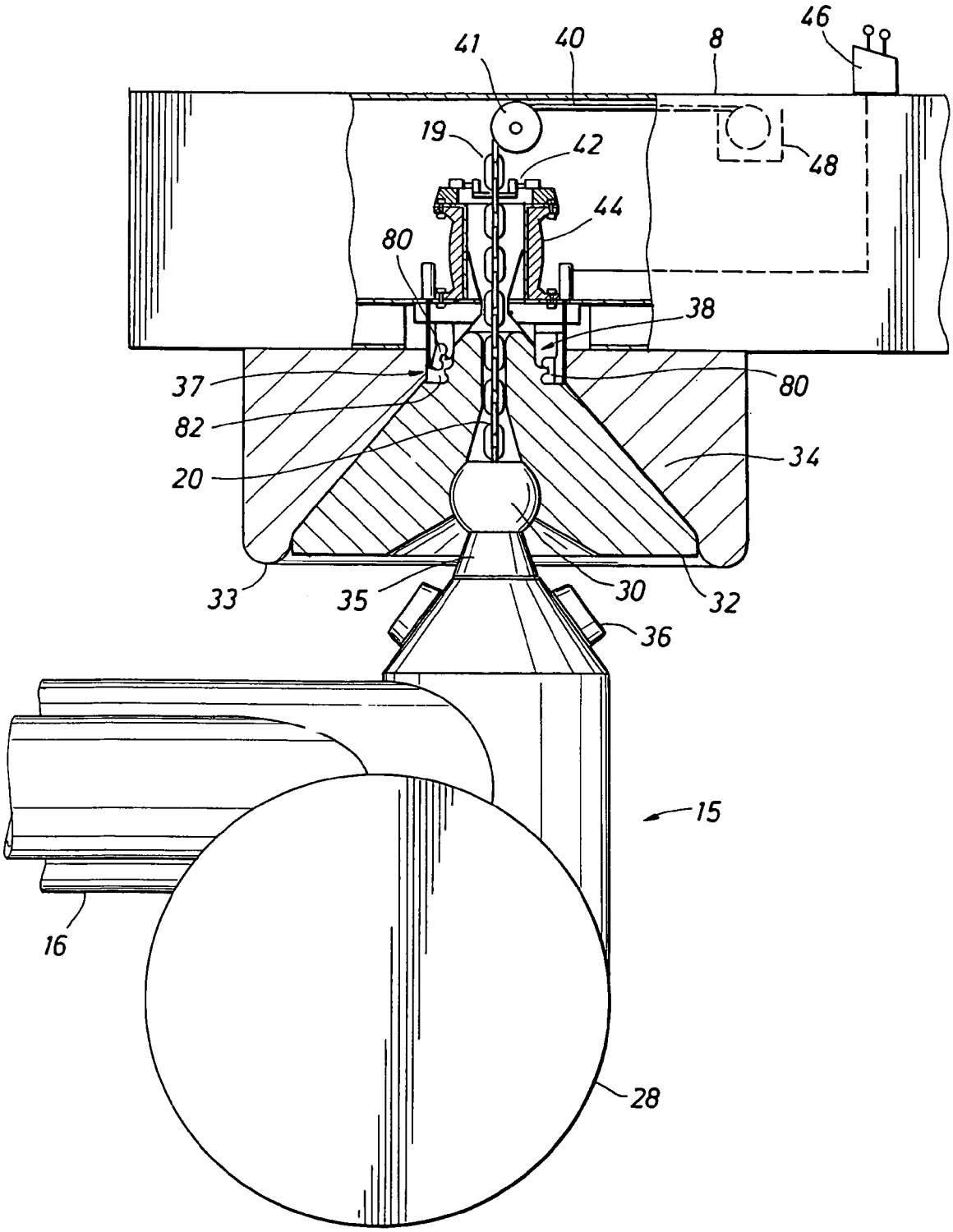
FIG. 3 is an elevation view partially in section through the yoke tip.
Figure 4A:
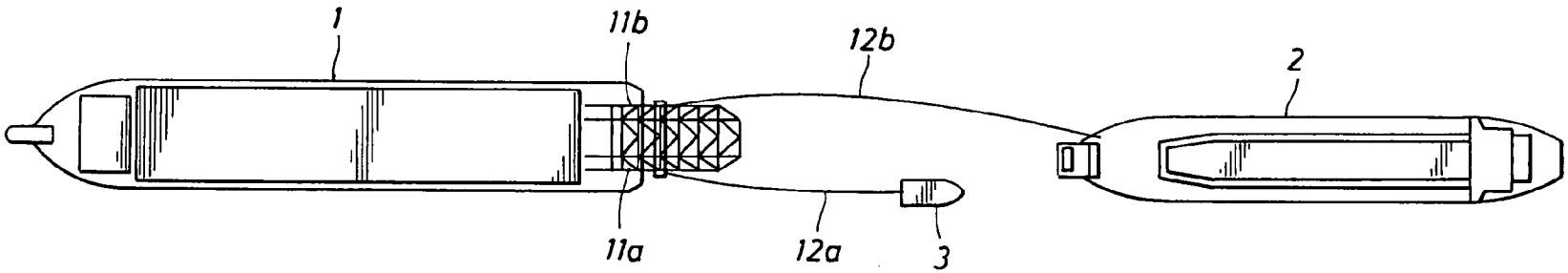
FIG. 4A is a top view showing a carrier vessel which has approached a FPSO process vessel for temporary mooring and offloading thereto.
Figure 4B:
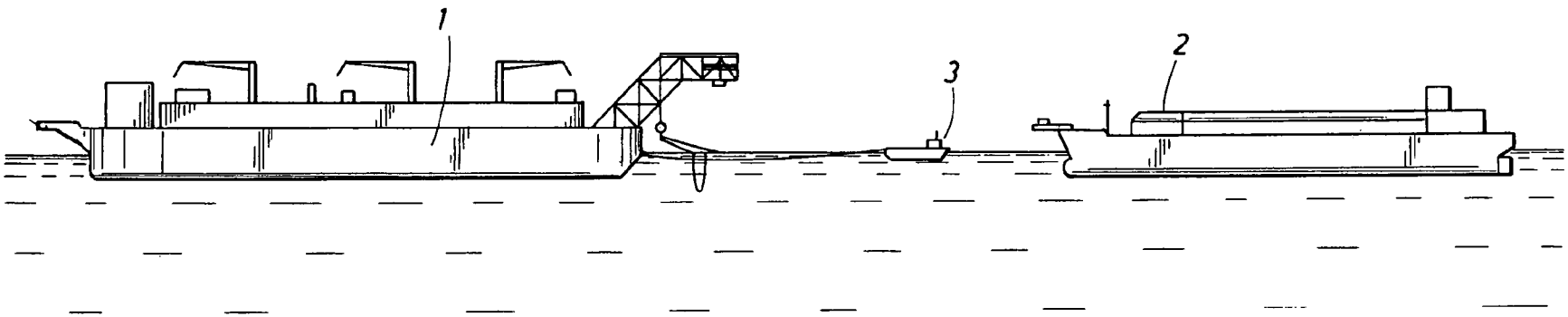
FIG. 4B is a side view showing a carrier vessel which has approached a FPSO process vessel for temporary mooring and offloading thereto.

FIGS. 2A and 2B show one embodiment of the invention of disconnectable mooring yoke 10 including hinge joints 14*a* and 14*b*, yoke frame 16, buoyant chamber 28, chain windlass 18, and guide cone 32 mounted on yoke 16 by a three-axis flexible joint 30. Chain 20 can be run out of, or retrieved into, chain locker 24 by rotationally powered chain pocket wheel 21. Chain guide wheel 22 maintains sufficient wrap of chain 20 around pocket wheel 21. Chain guide wheels 26*a* and 26*b* maintain chain 20 alignment around and upward through guide cone 32. The preferred connection of the yoke 10 to the LNG/FPSO 1 is described in U.S. provisional application No. 60/401,478 filed on Aug. 6, 2002, now U.S. application Ser. No. 10/636,994 filed on Aug. 6, 2003 and publlished on Feb. 12, 2004at U.S. patent application Ser. No. 2004/0094082, which is incorporated herein by reference. The frame 5 of the FPSO 1 to which the pantograph connection 4 is mounted is described in provisional application 60/408,274 filed on Sep. 6, 2002, also now U.S. application Ser. No. 10/636,994 filed on Aug. 6, 2003 and published on Feb. 12, 2004 as U.S. Patent Application Publication No. U.S. 2004/0094082, which is also incorporated herein by reference. The frame 5 of the FPSO 1 to which the pantograph connection 4 is mounted FIG. 3 illustrates a first embodiment of the invention with major components of the yoke tip 15 and bow extension 8. Guide cone 32 is flexibly and rotationally mounted on pedestal 35 of yoke tip 15 by means of three axis joint 30. Three-axis joint 30 is fabricated as a spherical ball joint, or a gimbaled cardan joint with a central third axis bearing, or an elastomeric flexible joint combined with a central third axis bearing, or the like. Elastomeric bumpers 36 are mounted on pedestal 35 and provide a cushioned stop for guide cone 32 at its extreme deflection angle. Chain 20 is fastened to LNG carrier bow extension 8 by means of chain end fitting 19 which is clamped by chain stopper 42 and supported by shock absorber 44. Shock absorber 44 is an elastomeric, spring-like element that minimizes shock loads in chain 20 while guide cone 32 is pulled toward receiver 34. An alternative of shock absorber 44 is to incorporate the elastomeric element into chain guide wheel 26*b* shown in FIG. 2B. In this alternative design, wheel 26*b* is mounted for example in a hinged bracket fastened at one end to shock absorber 44 so chain tension loads compress absorber 44. A more detailed description by reference to FIGS. 14A, 14B is presented below. Guide cone 32 is free to enter or be released from receiver 34 when a connector is in an unlocked position 37 as shown in FIG. 3. Guide cone 32 is held rigidly in receiver 34 by dogs 80 forced into grooves 82 when the connector is in the locked position 38. Operational control of the connector illustrated in positions 37 and 38 is performed at connector control station 46, or from a remote control station (not shown).

FIGS. 4 through FIG. 10 inclusive describe generally the method of connecting an approaching LNG carrier vessel 2 to a FPSO process vessel 1. The major sequential steps in the procedure begin as shown in FIG. 4A in which workboat 3 tows hawsers 12*a*, 12*b* from winches 11*a*, 11*b* out to LNG carrier vessel 2. Hawsers 12*a*, 12*b* are retrieved onto vessel 2 and secured as shown in FIG. 5A.

Vessel 2 is pulled closer to FPSO vessel 1 by turning winches 11*a*, 11*b* to pull in hawsers 12*a*, 12*b*. Chain windlass 18 has paid out a length of chain 20 below yoke 10 in preparation for retrieval of chain pull-in rope 40 onto vessel 2. Skilled personnel in control room 9 operate chain windlass 18. The embodiment shown in FIGS. 1 through 14 locate windlass 18 directly on yoke 10 and the windlass includes a hydraulic pump unit and oil reservoir contained within yoke frame structure 16 of yoke 10 driven by electrical current through power cables 23 from vessel 1. Messenger rope 17 is prepared for subsequent connection to floating rope 13 to enable retrieval of pull-in rope 40 into receiver 34.

Figure 5A:
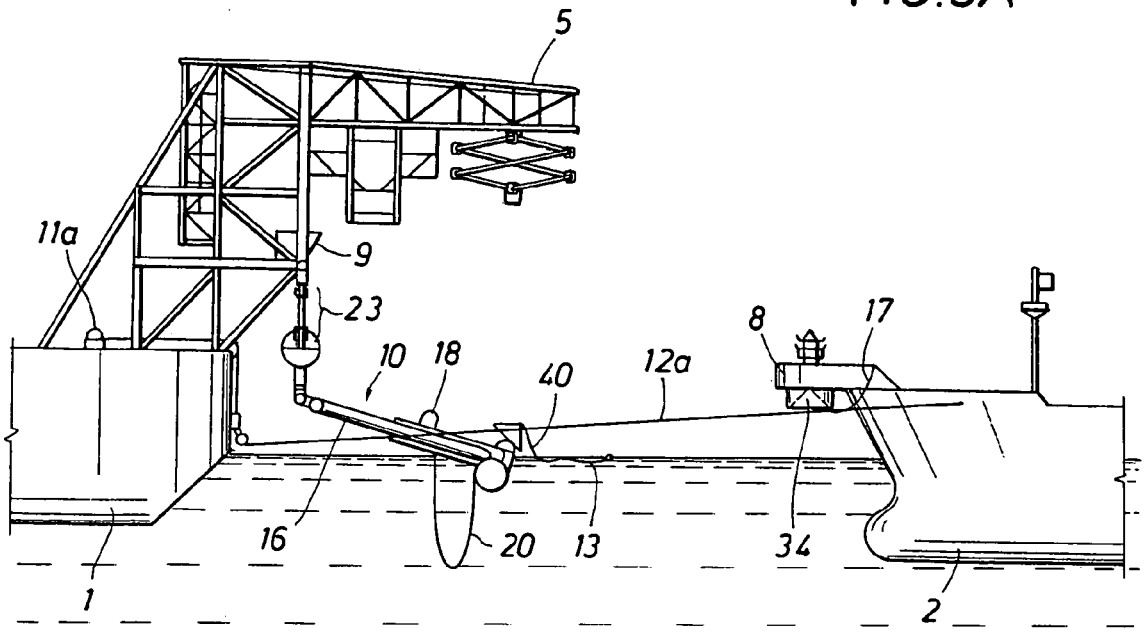
FIG. 5A shows hawsers from the FPSO process vessel retrieved by the carrier vessel and a messenger rope on the carrier vessel for retrieval of a floating rope connected to a chain windlass.
Figure 5B:
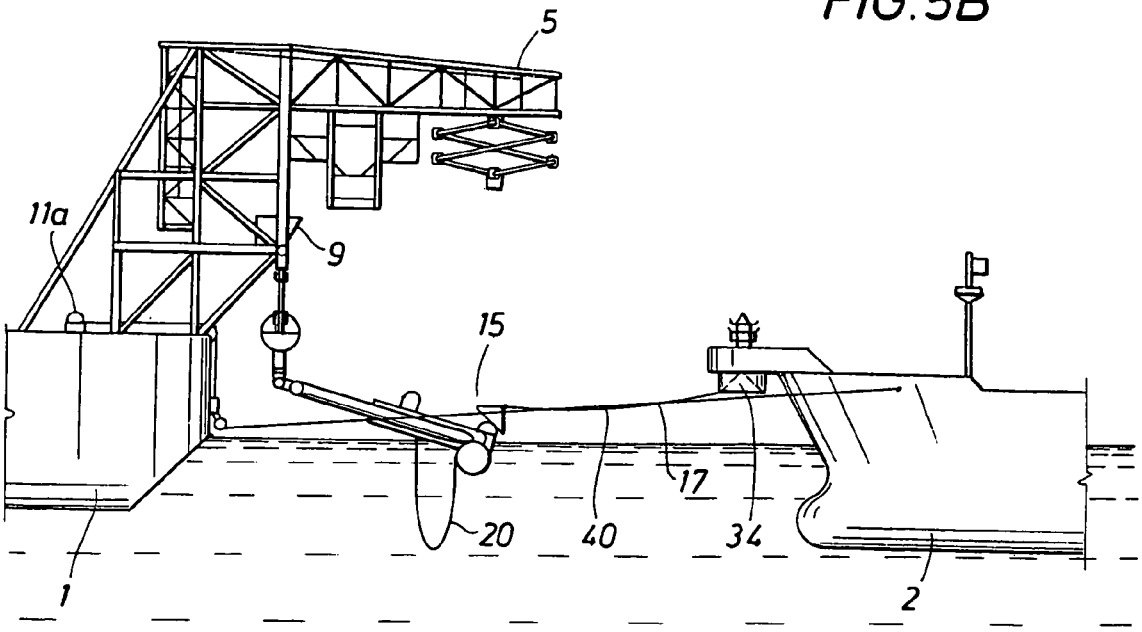
FIG. 5B shows a chain windlass on the yoke of the process vessel with a chain which has been retrieved by a chain pull-in rope from the carrier vessel.

FIG. 5B shows messenger rope 17 connected to pull-in rope 40 after vessel 2 crewmen have removed floating rope 13. Rope 17 and rope 40 are pulled toward vessel 2 by winch 48 on vessel 2 shown in FIG. 3.

Figure 6A:
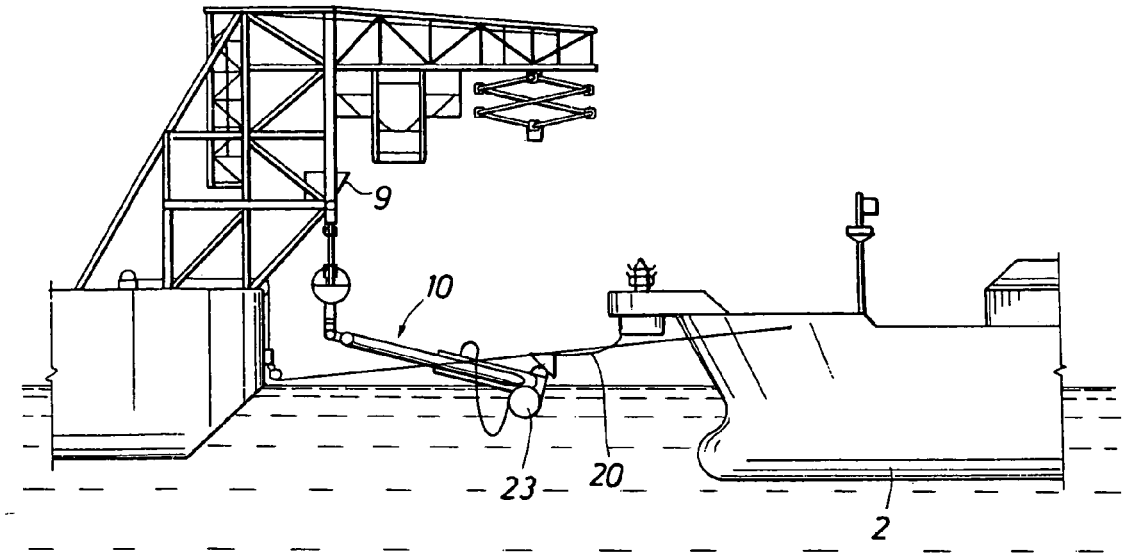
FIGS. 6A and 6B show the yoke floating in the sea while the chain is being pulled into the connector of FIG. 3.

FIG. 6A shows yoke 10 floating in the sea due to the buoyancy of chamber or tank 28. Chain 20 is now connected to rope 40 with chain end fitting 19 secured in hydraulically operated chain stopper 42. Again refer to FIG. 3.

Figure 6B:
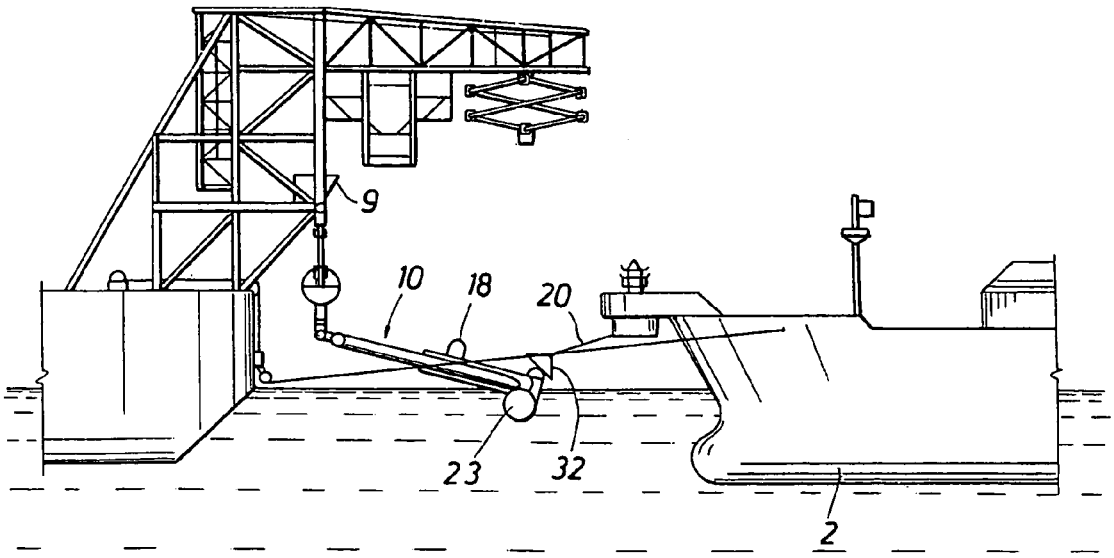

FIG. 6B illustrates chain 20 now being pulled through guide cone 32 by windlass 18, thereby drawing vessel 2 and mooring yoke 10 closer together, assisted by tension in hawsers 12*a*,12*b* from winch 11*a*,11*b*.

Figure 7A:
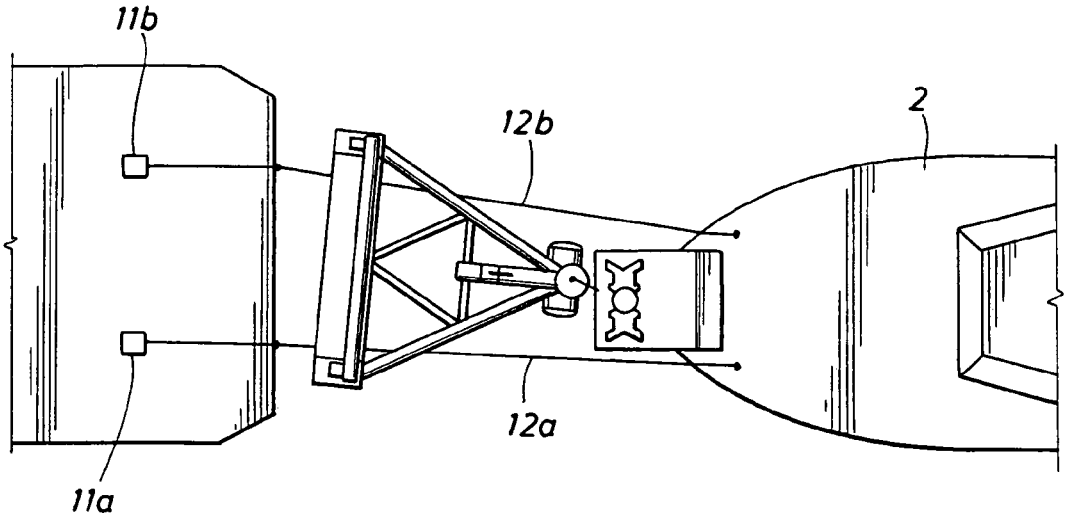
FIGS. 7A and 7B show a plan and side view respectively of the yoke tip approaching the connector on the end of the carrier vessel.
Figure 7B:
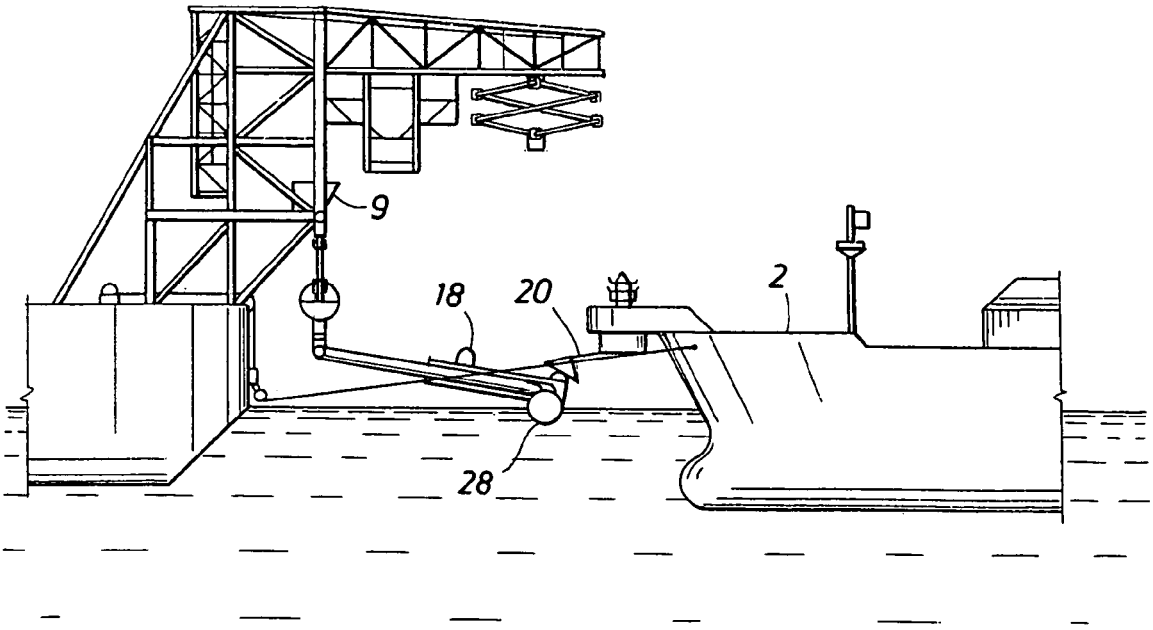

FIGS. 7A and 7B show vessel 2 moored by hawsers 12*a*, 12*b*, held by winches 11*a*, 11*b*, operated from control room 9 while windlass 18 pulls in more chain 20. Buoyant chamber 28 is being lifted from the sea, as chain 20 is pulled tighter. Wave action against yoke buoyant chamber 28 causes shock loads in chain 20 that react against elastic shock absorber 44 shown in FIG. 3.

Figure 8A:
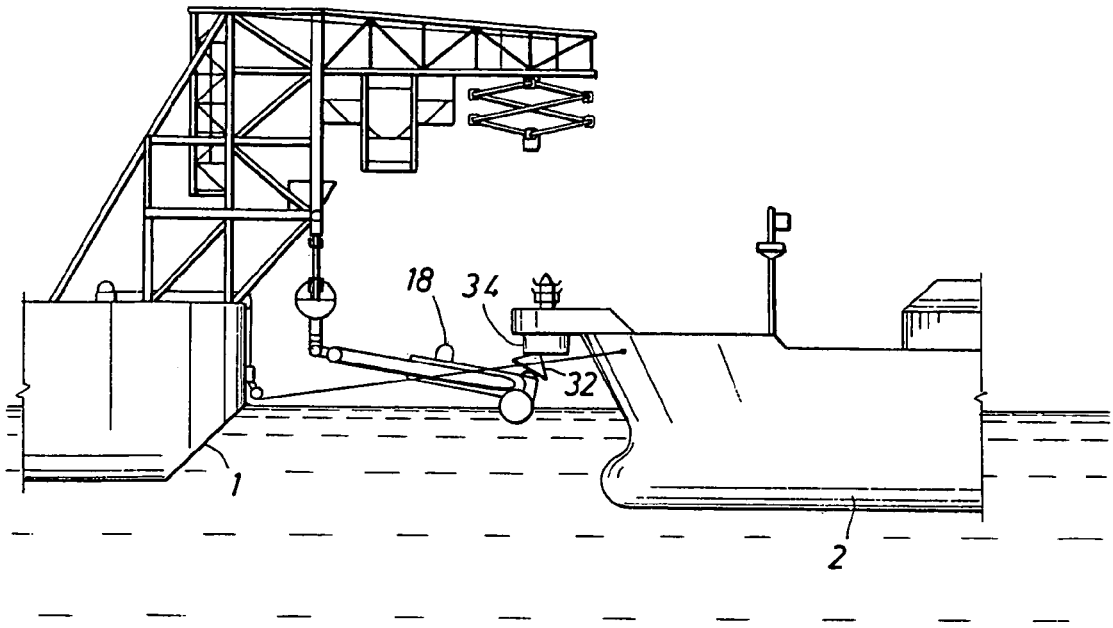
FIG. 8A shows a guide cone of a male connector at the tip of the yoke approaching the female connector at the end of the carrier vessel.

FIG. 8A illustrates guide cone 32 in contact with receiver 34. Cone 32 is self aligning and endures impact loading by transmitting and absorbing impact energy through absorber 44 and elastomeric bumper 36.

Figure 8B:
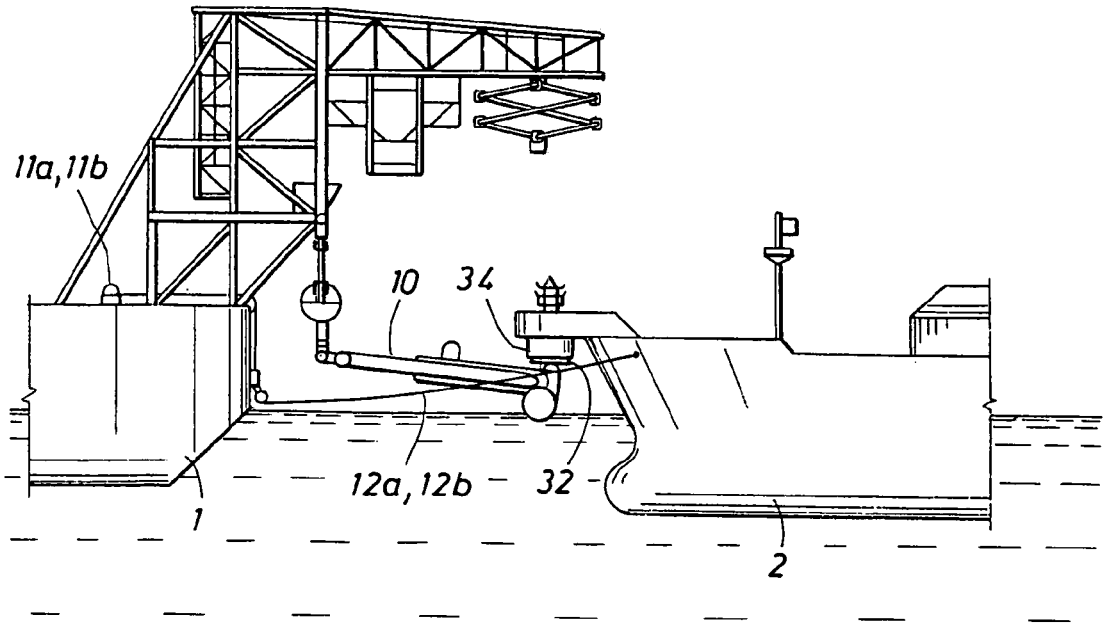
FIG. 8B shows the guide cone of the tip of the yoke almost fully connected to the female connector of the carrier vessel.

FIG. 8B shows guide cone 32 almost fully engaged into receiver 34.

Figure 9A:
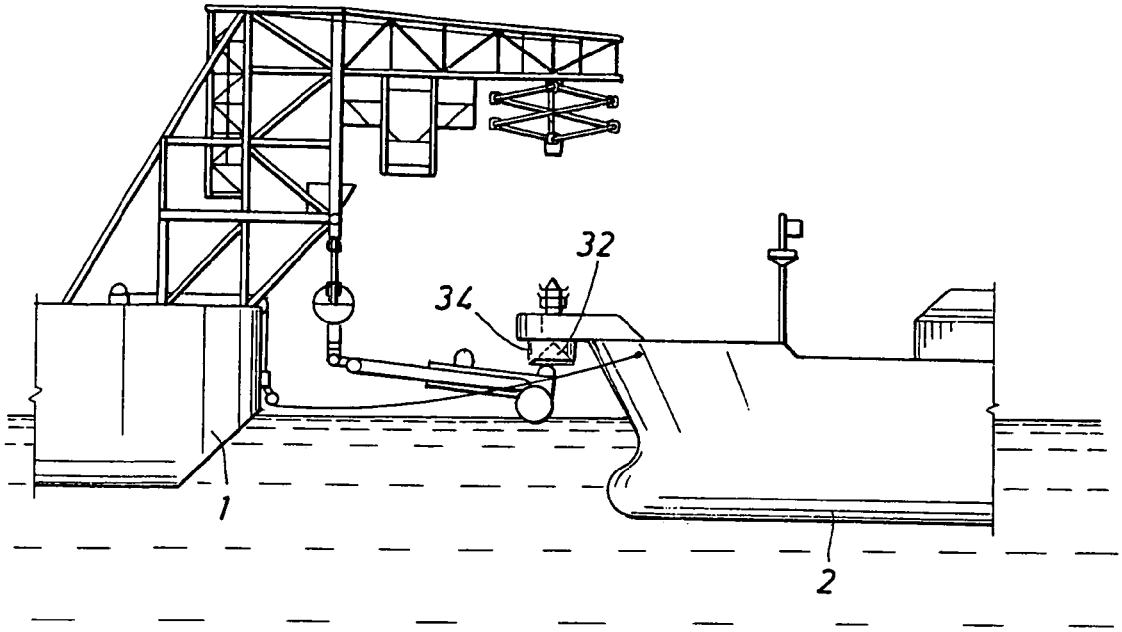
FIG. 9A shows the yoke end connector fully connected to the carrier vessel in preparation for hydrocarbon transfer from the FPSO process vessel to the carrier vessel.

FIG. 9A shows yoke 10 fully mooring vessel 2 to vessel 1 with guide cone 32 locked into receiver 34 by connector 38. (See FIG. 3)

Figure 9B:
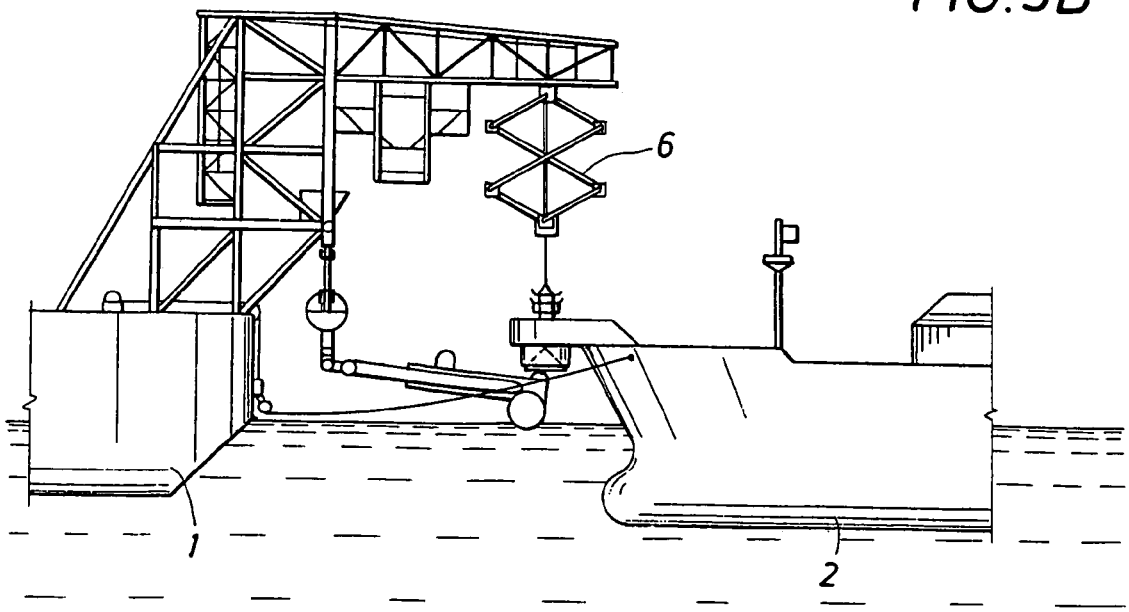
FIG. 9B shows a piping pantograph being pulled toward a transfer connector on the carrier vessel.

FIG. 9B illustrates vessel 2 moored to vessel 1 and with piping pantograph 6 being pulled down for connection to vessel 2.

Figure 10:
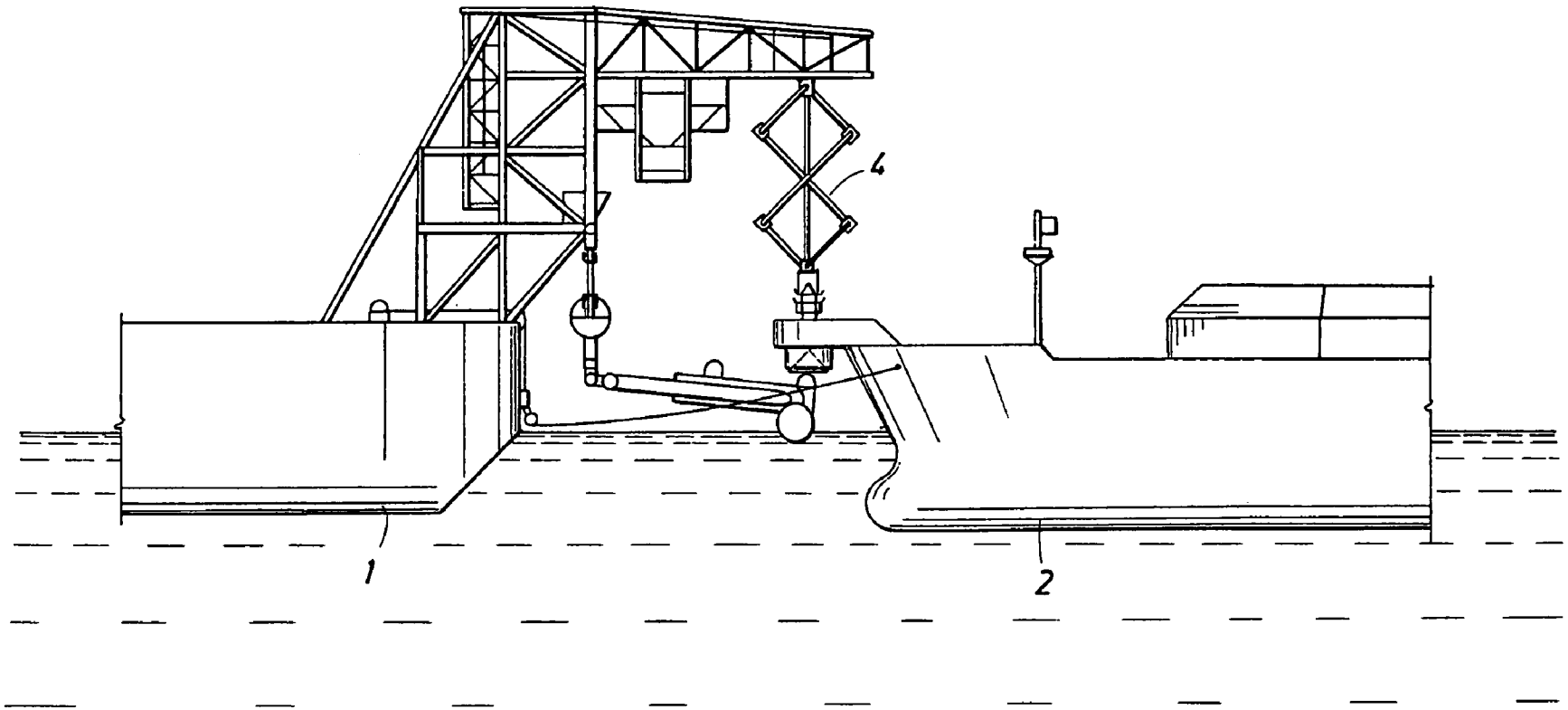
FIG. 10 shows the piping pantograph fully connected to the carrier vessel.

FIG. 10 shows the connection completed with vessel 2 moored to vessel 1 and an LNG transfer system 4 in the operational configuration.

Figure 11A:
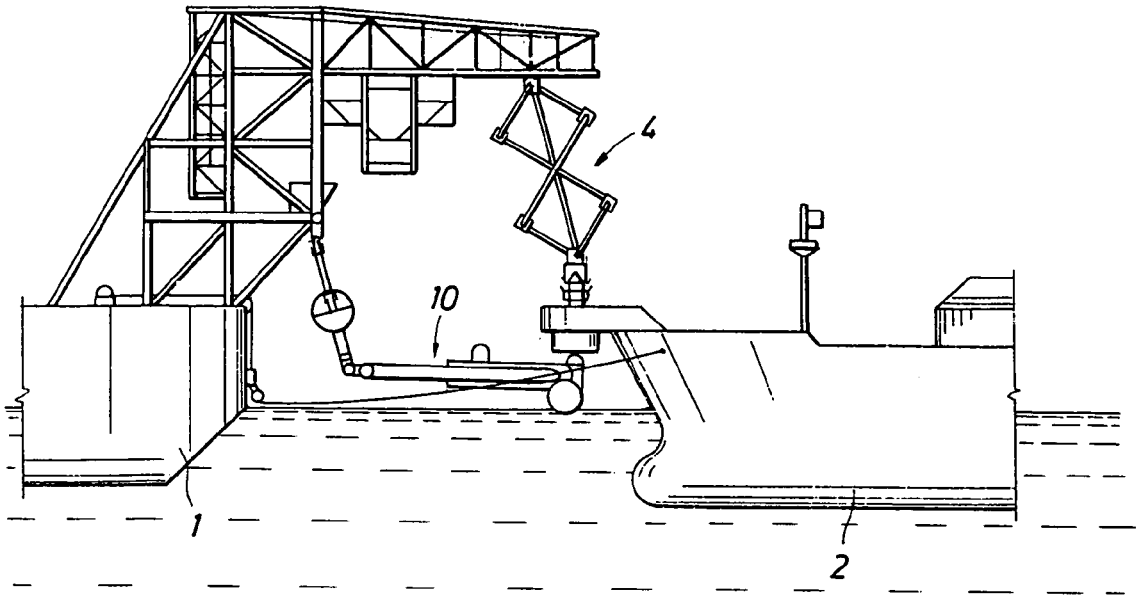
FIG. 11A shows an operating condition where the carrier vessel is moored via a yoke, yet the carrier vessel is offset longitudinally from the FPSO vessel.

FIG. 11A shows a typical operating condition just prior to completion of product transfer through transfer system 4 wherein vessel 2 is offset in the aft direction due to wind and wave forces. Vessel 2 could also be applying a reverse thrust with its main propeller.

Figure 11B:
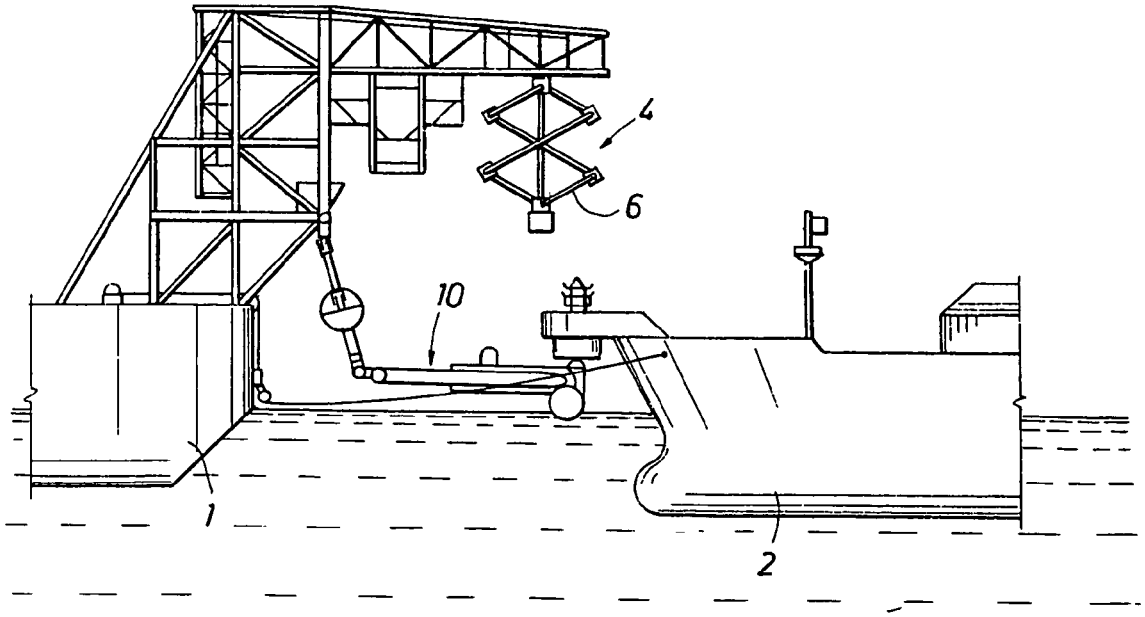
FIG. 11B shows the pantograph disconnected from the carrier vessel, while the carrier vessel continues to be connected to the yoke.

FIG. 11B shows transfer system 4 disconnected and piping pantograph 6 folding upward away from vessel 2 while vessel 2 remains securely moored to vessel 1 by yoke 10.

Figure 12A:
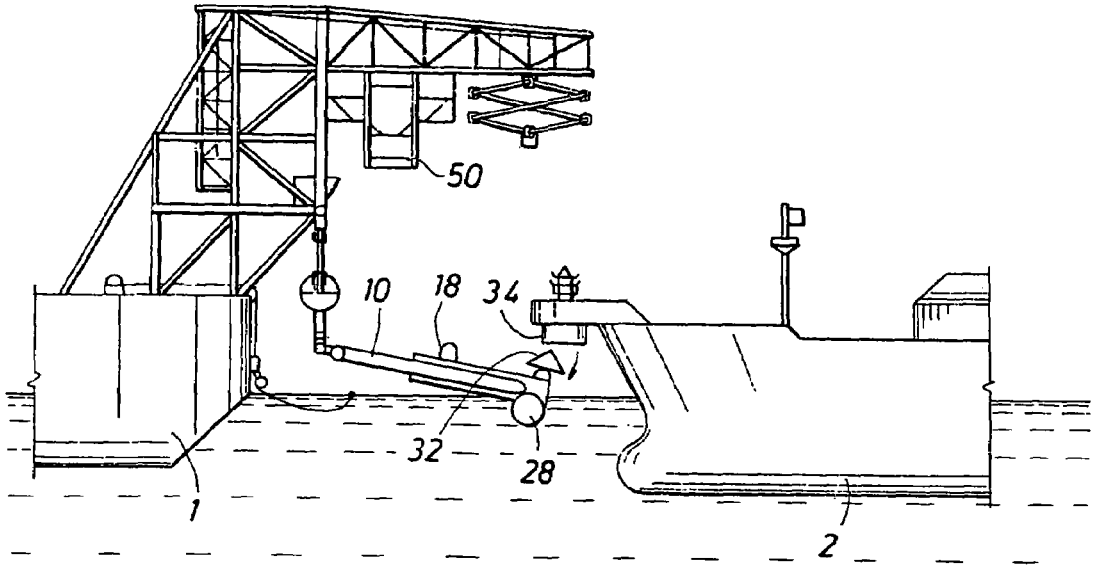
FIG. 12A shows the connector of the yoke disconnected from the connector of the carrier vessel, but with the yoke floating in the sea.

FIG. 12A illustrates yoke 10 being lowered into the sea following release of connector 38 from engagement with guide cone 32 (See FIG. 3). A disconnection under normal circumstances such as relatively mild weather conditions can be done by releasing connector 38 while chain 20 remains engaged by end fitting 19 in chain stopper 42 (again refer to FIG. 3). Windlass 18 then pays out chain thereby lowering guide cone 32 away from receiver 34 until buoyant chamber 28 rests in the sea. At that point stopper 42 hydraulically releases chain 20, and chain 42 is lowered away by winch 48 by paying out rope 40. An alternative quick release can be performed, such as in an emergency, by releasing stopper 42 from chain end fitting 19, then releasing connector 38, thereby allowing guide cone 32 to rapidly drop away from receiver 34.

Figure 12B:
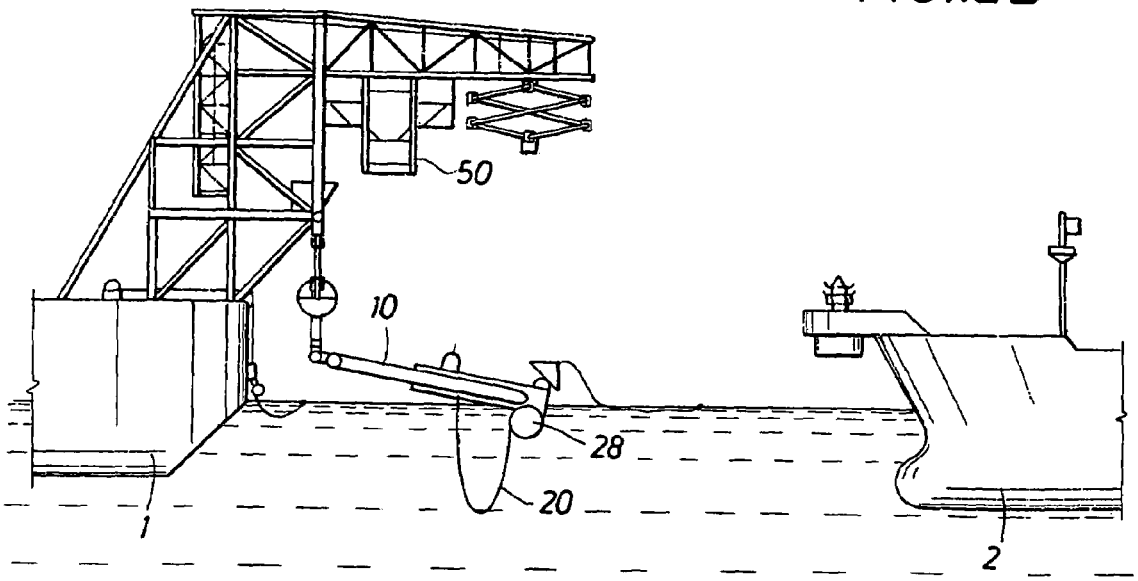
FIG. 12B shows the carrier vessel that has moved away from the FPSO process vessel.

FIG. 12B shows vessel 2 backing away from vessel 1 following disconnection from yoke 10 that is now floating in the sea.

Figure 13A:
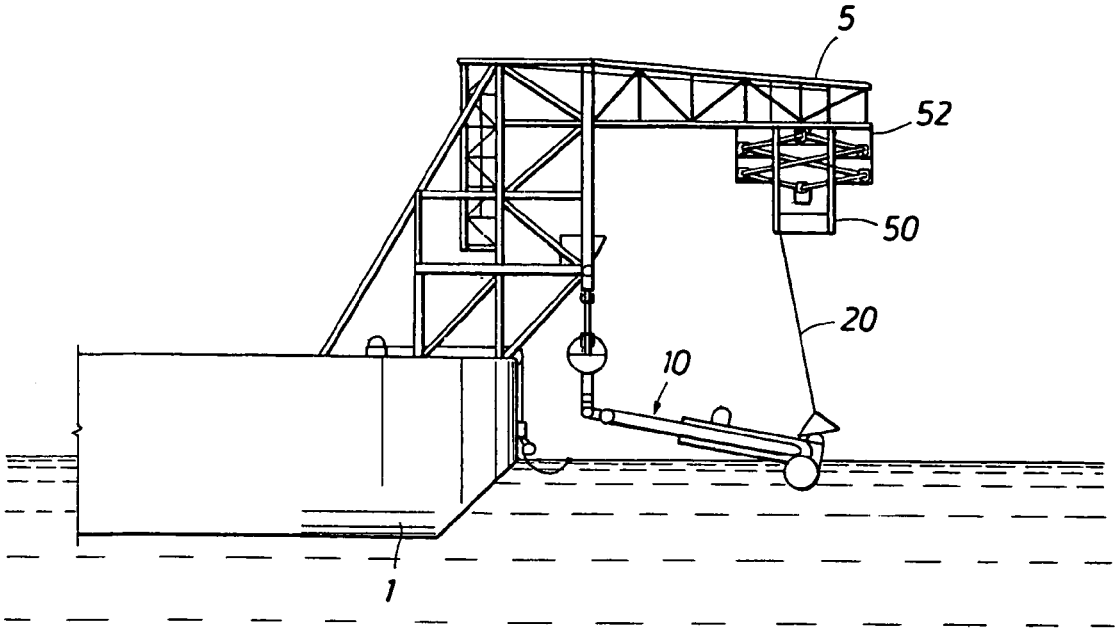
FIG. 13A shows the yoke beginning to be lifted out of the sea.

FIG. 13A illustrates yoke 10 being prepared for lifting clear of the sea for parking or service purposes during long periods while awaiting a carrier vessel to arrive. Service platform 50 is moved over piping pantograph 5 by trolley 52. Chain 20 is then connected to service platform 50, or alternatively, directly to support frame 5.

Figure 13B:
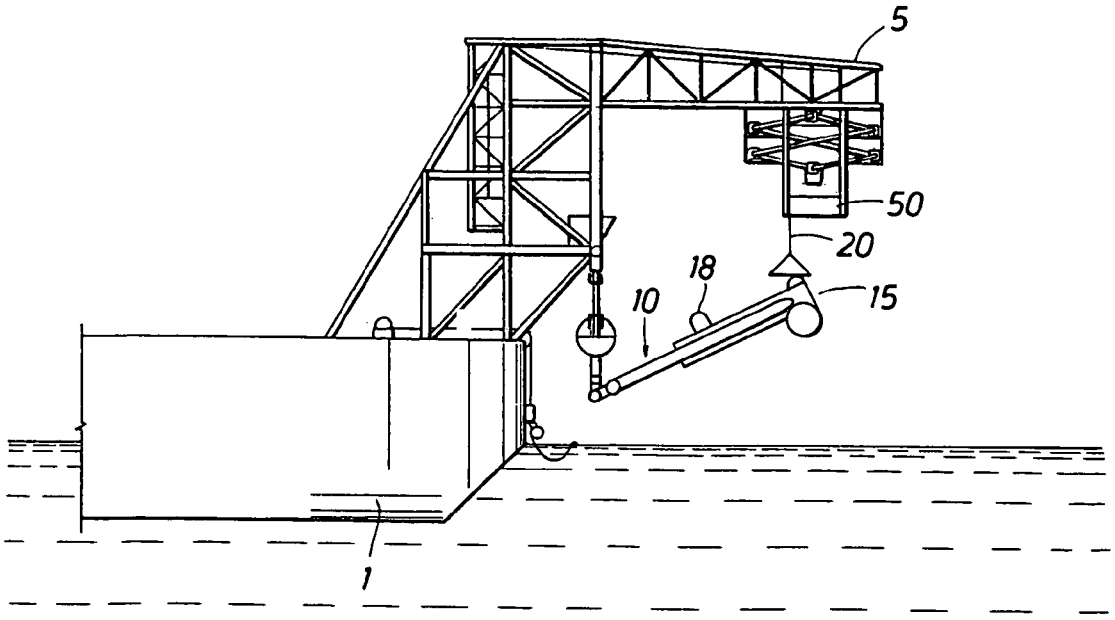
FIG. 13B shows the yoke lifted to its storage position out of the sea.

FIG. 13B shows yoke 10 raised up to a maximum height while suspended by chain 20 connected to platform 50, or alternatively connected to frame 5. Although not shown in FIG. 13B, additional snubbing lines would be connected from vessel 1 to yoke 10 to prevent undesirable motions while suspended above the sea. Another embodiment for suspending the yoke includes additional wire rope cables (not shown), one or more, attached to auxiliary winches (not shown) mounted on support frame 5 and connecting to support points at the yoke tip. The auxiliary winches mounted on frame 5 are arranged to lift yoke tip 15 up out of the sea.

FIGS. 14A and FIG. 14B illustrate an alternative arrangement of equipment for pulling yoke 10 and vessel 2 together and for ultimately engaging cone 32 into receiver 34 (again refer to FIG. 3). The arrangement of FIGS. 14A and 14B provides an alternative to utilizing chain 20 as described in the previous embodiments. Shock absorber 44, shown in FIG. 3, is not be used, and instead elastomeric spring 120 is installed in yoke tip 15 to serve the same purpose of absorbing shock loads in rope 110 during yoke pull-in. The advantage of this embodiment is that it is characterized by lighter total yoke weight and lower manufacturing cost.

Rope 110 is preferably a high strength synthetic fiber rope such as Marlow Steelite™ lightweight fiber rope manufactured using Dyneema® HMPE fiber. The yoke retrieval operations sequence is essentially the same for this embodiment as was previously described for using retrieval chain 20. The retrieval process begins with floating rope 13 being retrieved onto vessel 2 as described above and shown in FIG. 5A and FIG. 5B. Winch 100 rotationally releases drum 106 to allow rope 110 to be freely pulled toward vessel 2 by means of rope 40 being wound onto winch 48 on bow extension 8 of vessel 2. Floating rope 13 and rope 40 are each made to a practical length of about 20 meters or longer. After end fitting 19 travels into stopper 42, winch 100 can begin pulling in rope 110. Rope 110 travels down through a central opening in guide cone 32, through joint 30, around vertically moveable sheave 130, around fixed sheave 114, and then to winch drum 106. Shock loads occurring in rope 110 cause moveable sheave 130 and sheave frame 134 to be lifted upward thereby compressing elastomeric spring 120.

Spring 120 is a commercially available component typically used for dock bumpers for berthing ships. Compression of spring 120 absorbs large quantities of energy, thereby greatly reducing the peak loads in rope 110. Spring 120 is firmly attached to support bracket 136 to transmit rope 110 loads into yoke structure 16.

FIGS. 15 through 18 illustrates another embodiment of the invention where a rope winch 100' is positioned not on the yoke itself, but on the stern of the vessel 1 in the vicinity of winch 11*a* but near the centerline of vessel 1. The tension member 110 in this embodiment is a high strength synthetic fiber rope as described above, and is wound around rope sheaves 140, 142 and 144 and is terminated in an end fitting 19' as shown in FIG. 16B. FIG. 16A illustrates the receiver 34' carried by extension or connection module 8. A hydraulic connector 42' is secured on connection module 8 to selectively capture end fitting 19' when it is pulled upward by messenger line 40' similar to the illustration of FIGS. 2B and 3. FIG. 16C illustrates, in a cross-section cut away elevation drawing, the mating cone 32' via cone extension member 32" locked in the connector 42' after it has been fully pulled in and locked. The mating cone 32' is carried on a two-axis gimbaled joint 90 with an internal vertical axis yaw bearing 91 which allows the cone 32' and cone extension member 32" to rotate about a vertical axis through a center line through pedestal 35. An elastomeric flex joint can be substituted for the two-axis gimbaled joint. Such a flex joint can be a universal type (Hooke's joint) or a tapered stress joint of metallic or composite construction, or a flex joint 93 (see FIG. 16D) using metallic or composite materials. Cone extension member 32" is sized for allow rope 110 to pass through its center (see FIG. 16B) and has an outer profile 92 arranged with grooves so that locking members or dogs 80 of connector 42 can lock yoke tip 15' to receiver 34'.

Figure 15:
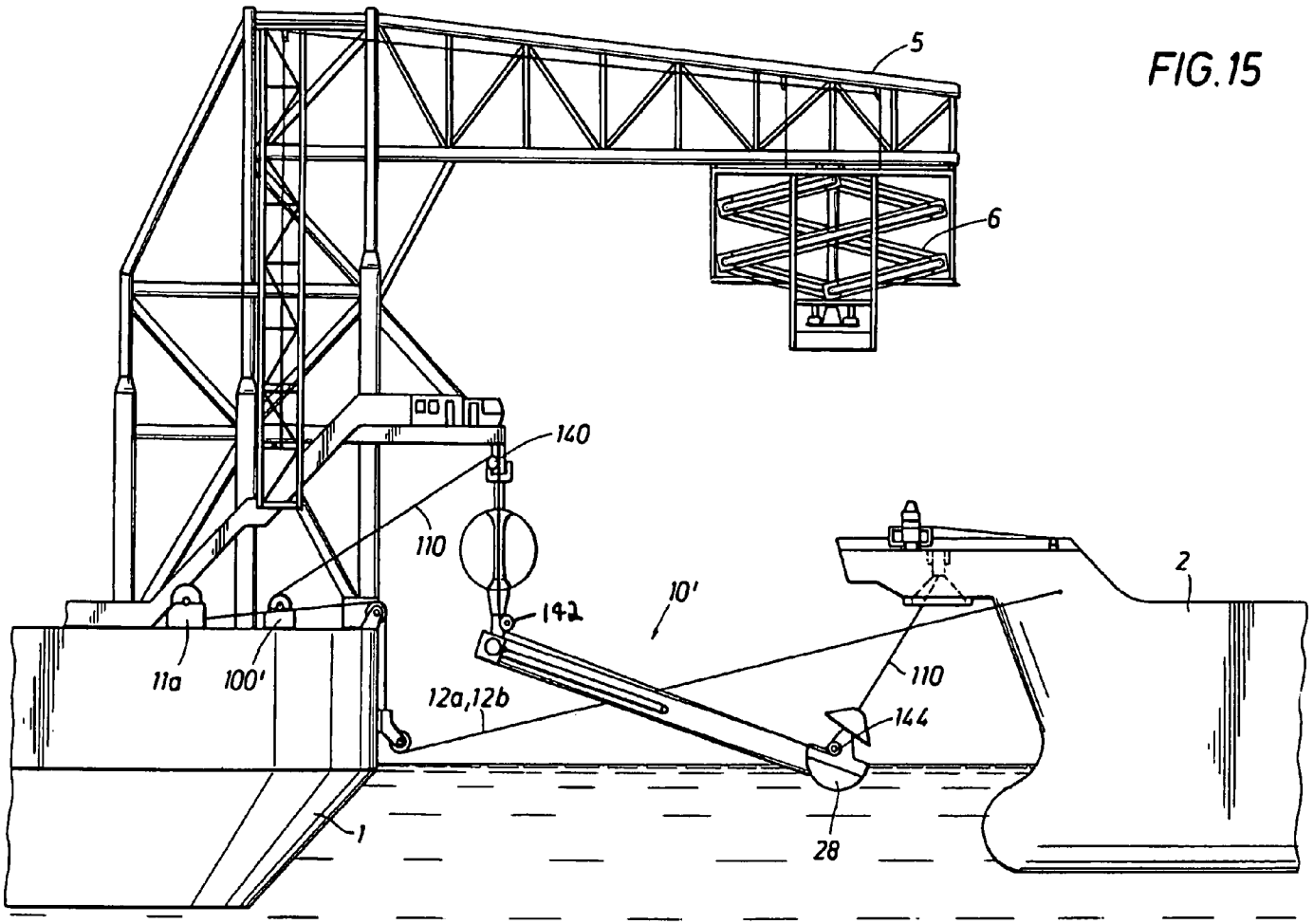
FIG. 15 is an elevation view of an alternative yoke mooring arrangement with a windlass mounted on the LNG/FPSO vessel pulling a rope for connecting the LNG to the FPSO.
Figure 16C:
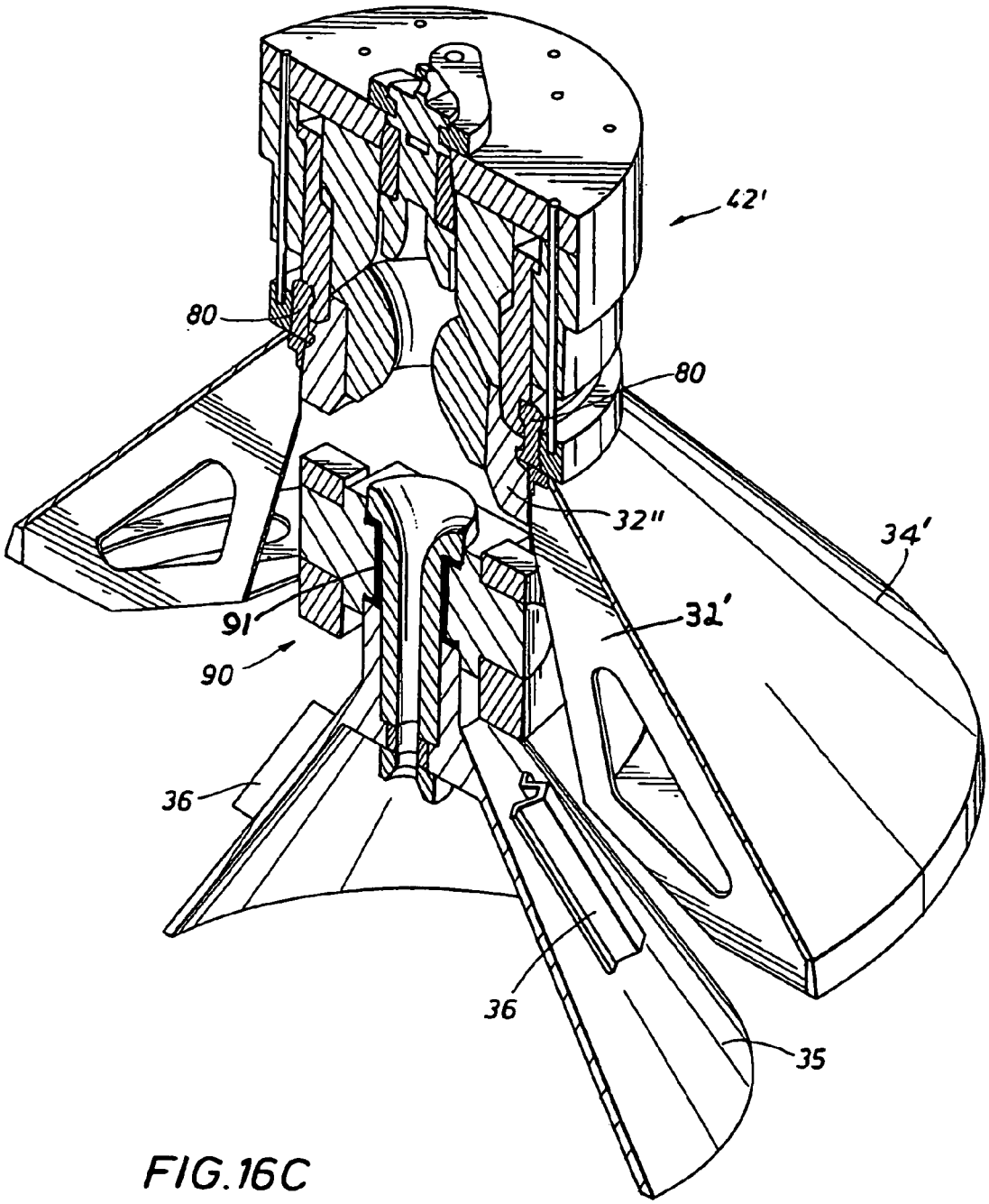
FIG. 16C is a partially cut-away perspective view of the mating cone of the yoke tip locked to a connector which illustrates connection of the mating cone to a three-axis gimbaled joint and connection of the mating cone to a hydraulic connector on an extension of the vessel.
Figure 16D:
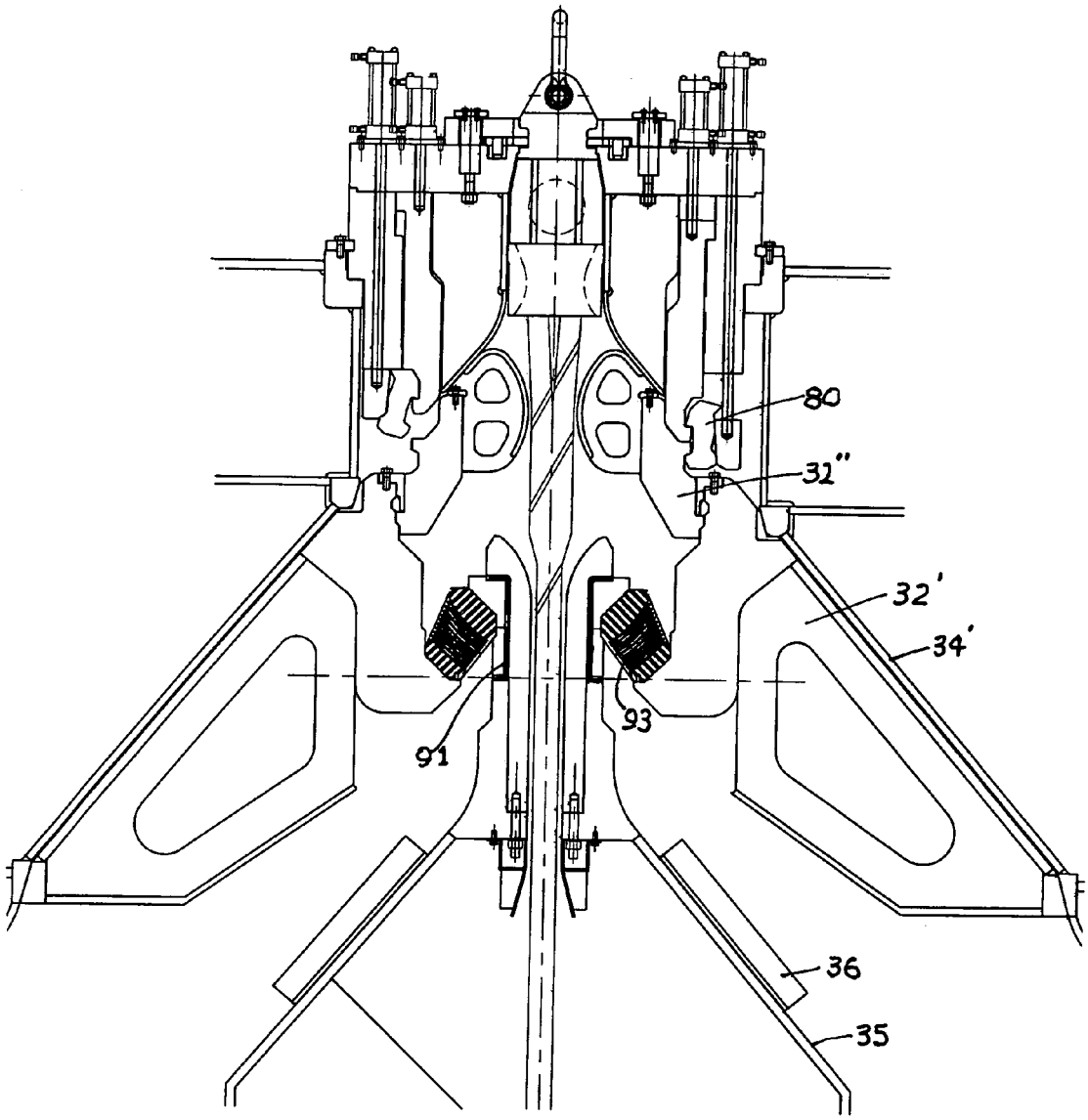
FIG. 16D illustrates the mating cone locked to a connector with a yaw bearing and a flex joint substituted for the gimbaled joint of FIG. 16C.
Figure 17:
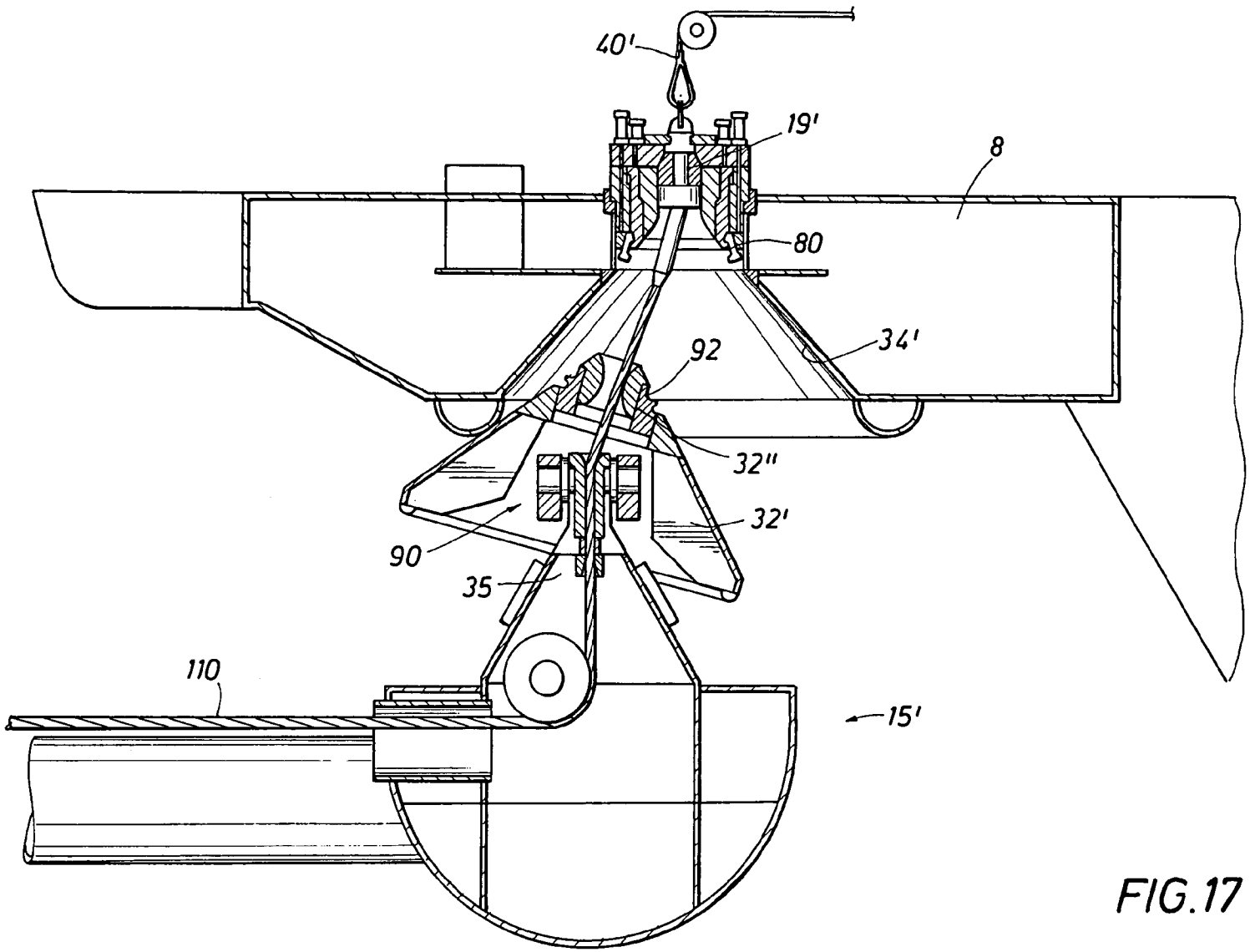
FIG. 17 illustrates the yoke tip as it is being pulled into the receiver as the windlass on the LNG/FPSO vessel pulls on the retrieval rope with the mating cone entering the receiver on the bow extension.
Figure 18:
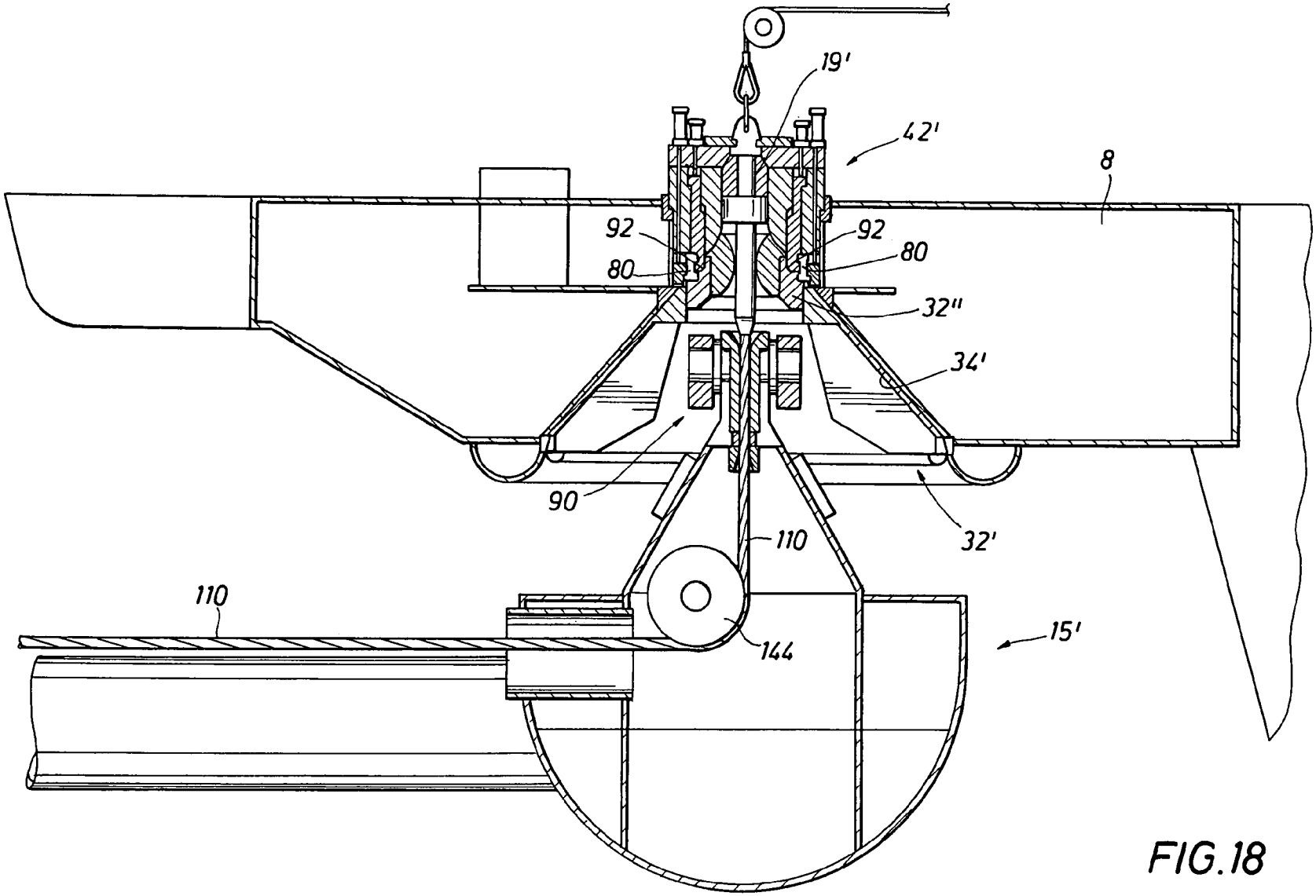
FIG. 18 illustrates the yoke tip locked in the receiver.

FIG. 17 shows the rope fitting 19' locked in connector 42' with the yoke tip 15' being pulled up into receiver 34' because of pulling on rope 110 by winch 100' (FIG. 15). During this phase of the connection, the cone extension member 32" bears against rope 110 to tilt cone 32' to guide the cone 32' with receiver 34'. FIG. 18 shows the mating cone 32' locked into receiver 34' with hydraulic dogs 80 closed onto grooves on the outer profile 90 of cone extension member 32".

What is claimed is:

1. An assembly for mooring a vessel (2) at sea to a body (1) comprising a yoke (10, 10') selectively disconnectably coupled between said vessel (2) and said body (1) and having first and second ends with a non-disconnectable coupling arrangement between said first end and said body and a disconnectable coupling arrangement between said second end and said vessel, said non-disconnectable coupling arrangement including a pivoted connection between said first end of said yoke (10, 10') and said body (1) that allows said yoke to rotate about a horizontal axis, said disconnectable coupling arrangement including a first coupling member (32, 32') at said second end of said yoke which is arranged and designed for mating with a second coupling member (34, 34') carried by said vessel (2), a tension member (20, 110) arranged and designed to extend through said first and second coupling members and to be coupled between a winch mechanism (18, 18', 106) and a connector (42, 42'), said mechanism and connector being arranged and designed to pull said first coupling mechanism (32, 32') into engagement with said second coupling mechanism (34, 34'), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), wherein said body (1) is an LNG process vessel, and said vessel (2) is an LNG carrier vessel, said first coupling member includes a male guide cone (32) mounted on a multiple axis joint (30) which is attached to said second end of said yoke (10), said second coupling member includes a female receiver (34) mounted on an extension (8) of said vessel (2) and arranged and designed to receive said guide cone (32), said connector (42) is mounted on said extension (8), said winch mechanism (21) is mounted on said yoke (10), and said tension member (20) extends from said connector (42) through said multiple axis joint and via guide wheels (26*a*, 26*b*) to said winch mechanism (21).

2. The assembly of claim 1 comprising, a buoyant element (28) located at said second end of said yoke (10) to cause said second end of said yoke (10) not to sink when said first and second coupling members are selectively disconnected and said second end of said yoke (10) rotates about said horizontal axis into the sea.

3. An assembly for mooring a vessel (2) at sea to a body (1) comprising a yoke (10, 10') selectively disconnectably coupled between said vessel (2) and said body (1) and having first and second ends with a non-disconnectable coupling arrangement between said first end and said body and a disconnectable coupling arrangement between said second end and said vessel, said non-disconnectable coupling arrangement including a pivoted connection between said first end of said yoke (10, 10') and said body (1) that allows said yoke to rotate about a horizontal axis, said disconnectable coupling arrangement including a first coupling member (32, 32') at said second end of said yoke which is arranged and designed for mating with a second coupling member (34, 34') carried by said vessel (2), a tension member (20, 110) arranged and designed to extend through said first and second coupling members and to be coupled between a winch mechanism (18, 18', 106) and a connector (42, 42'), said mechanism and connector being arranged and designed to pull said first coupling mechanism (32, 32') into engagement with said second coupling mechanism (34, 34'), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), wherein said body (1) is an LNG process vessel, and said vessel (2) is an LNG carrier vessel, said first coupling member includes a male guide cone (32) mounted on a multiple axis joint (30) which is attached to said second end of said yoke (10), and said second coupling member includes a female receiver (34) mounted on an extension (8) of said vessel (2) and arranged and designed to receive said guide cone (32), and said multiple-axis joint is a spherical ball joint.

4. An assembly for mooring a vessel (2) at sea to a body (1) comprising a yoke (10, 10') selectively disconnectably coupled between said vessel (2) and said body (1) and having first and second ends with a non-disconnectable coupling arrangement between said first end and said body and a disconnectable coupling arrangement between said second end and said vessel, said non-disconnectable coupling arrangement including a pivoted connection between said first end of said yoke (10, 10') and said body (1) that allows said yoke to rotate about a horizontal axis, said disconnectable coupling arrangement including a first coupling member (32, 32') at said second end of said yoke which is arranged and designed for mating with a second coupling member (34, 34') carried by said vessel (2), a tension member (20, 110) arranged and designed to extend through said first and second coupling members and to be coupled between a winch mechanism (18, 18', 106) and a connector (42, 42'), said mechanism and connector being arranged and designed to pull said first coupling mechanism (32, 32') into engagement with said second coupling mechanism (34, 34'), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), wherein said body (1) is an LNG process vessel, and said vessel (2) is an LNG carrier vessel, said tension member is a chain (20) having a chain end fitting (19), said connector is a chain stopper (42) mounted on a shock absorber (44) carried by an extension (8) of said vessel (2), said chain stopper arranged and designed for selectively clamping said chain end fitting (19), whereby, said shock absorber (44) minimizes shock loads to said chain (20) while said first coupling member (30, 32) is pulled toward said second coupling member (34).

5. An assembly for mooring a vessel (2) at sea to a body (1) comprising a yoke (10, 10') selectively disconnectably coupled between said vessel (2) and said body (1) and having first and second ends with a non-disconnectable coupling arrangement between said first end and said body and a disconnectable coupling arrangement between said second end and said vessel, said non-disconnectable coupling arrangement including a pivoted connection between said first end of said yoke (10, 10') and said body (1) that allows said yoke to rotate about a horizontal axis, said disconnectable coupling arrangement including a first coupling member (32, 32') at said second end of said yoke which is arranged and designed for mating with a second coupling member (34, 34') carried by said vessel (2), a tension member (20, 110) arranged and designed to extend through said first and second coupling members and to be coupled between a winch mechanism (18, 18', 106) and a connector (42, 42'), said mechanism and connector being arranged and designed to pull said first coupling mechanism (32, 32') into engagement with said second coupling mechanism (34, 34'), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), wherein said body (1) is an LNG process vessel, and said vessel (2) is an LNG carrier vessel, said connector is a selectively operated clamping device carried by an extension (8) of said vessel (2), said tension member has a fitting (19) arranged and designed for being secured by said clamping device, and guide wheels (130, 114) are mounted on a support bracket (136) carried by an elastomeric spring (120) at said second end of said yoke (10).

6. The assembly of claim 5 wherein, said tension member is a rope (110).

7. An assembly for mooring a vessel (2) at sea to a body (1) comprising a yoke (10, 10') selectively disconnectably coupled between said vessel (2) and said body (1) and having first and second ends with a non-disconnectable coupling arrangement between said first end and said body and a disconnectable coupling arrangement between said second end and said vessel, said non-disconnectable coupling arrangement including a pivoted connection between said first end of said yoke (10, 10') and said body (1) that allows said yoke to rotate about a horizontal axis, said disconnectable coupling arrangement including a first coupling member (32, 32') at said second end of said yoke which is arranged and designed for mating with a second coupling member (34, 34') carried by said vessel (2), a tension member (20, 110) arranged and designed to extend through said first and second coupling members and to be coupled between a winch mechanism (18, 18', 106) and a connector (42, 42'), said mechanism and connector being arranged and designed to pull said first coupling mechanism (32, 32') into engagement with said second coupling mechanism (34, 34'), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), wherein said body (1) is an LNG process vessel, and said vessel (2) is an LNG carrier vessel, said first coupling member includes a male guide cone (32) mounted on a multiple axis joint (30) which is attached to said second end of said yoke (10), said second coupling member includes a female receiver (34) mounted on an extension (8) of said vessel (2) and arranged and designed to receive said guide cone (32)

said multiple-axis joint (30) is mounted on a pedestal (35) at said second end of said yoke (10), and bumpers (36) are mounted on said pedestal (35) at a position below said guide cone (32) and arranged and designed to provide a cushioned stop for said guide cone at extreme deflection angles.

8. A method of mooring a vessel (2) to a body (1) in the sea comprising the steps of, providing a mooring yoke (10) with a first end pivoted at said body and with a second end having a guide cone (32) and buoyant element (28) provided thereon with said second end of said yoke floating on the sea, providing a winching mechanism with a tension member (20) and pull-in rope (40) paid out, with said pull-in rope extending through said guide cone (32), mounting a receiver (34) on an extension member (8) of said vessel (2), providing a messenger rope (17) wound on a winch (48) on said vessel (2), connecting said messenger rope (17) to said pull in rope (40) and pulling said messenger rope (17) and said pull in rope (40) until said tension member (20) is within said receiver (34), clamping said tension member (20) in said receiver (34), winding said tension member (20) on said winching mechanism (18), thereby pulling said second end of said yoke (10) upward from the sea while pulling said guide cone (32) into said receiver (34), and selectively locking said receiver (34) and said guide cone, thereby mooring said vessel (2) to said body via said yoke (10).

9. The method of claim 8 further comprising the step of pulling said vessel (2) toward said body (1) with hawsers (12*a*, 12*b*) connected to winches (11*a*, 11*b*) on said body (1) while said messenger rope (17) pulls tension member (20) into said receiver (34) and while said tension member (20) is pulled by said winching mechanism (18) until said guide cone (32) is pulled in said receiver (34).

10. The method of claim 8 wherein said winching mechanism is a windlass (18) mounted on said mooring yoke (10).

11. The method of claim 8 wherein said winching mechanism is a rope winch mounted on said body (1).

12. An assembly for mooring a first vessel (2) at sea to a second vessel (1) comprising, a yoke (10') selectively disconnectably coupled between said first vessel (2) and said second vessel (1) and having first and second ends with a non-disconnectable coupling arrangement between said first end and said second vessel (1) and a disconnectable coupling arrangement between said second end and said first vessel, said non-disconnectable coupling arrangement including a pivoted connection between said first end of said yoke and said second vessel that allows said yoke (10') to rotate about a horizontal axis, said second end of said yoke having a buoyant element (28) to cause said second end of said yoke (10') not to sink when said second end of said yoke rotates about said horizontal axis into the sea, said disconnectable coupling member including a first coupling member (32') at said second end of said yoke which is arranged and designed with a second coupling member (34') carried by said first vessel (2), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), a tension member (20, 110) arranged and designed to extend through said first and second coupling members and to be coupled between a winch mechanism (18, 18', 106) and a connector (42, 42'), said winch mechanism and connector being arranged and designed to pull said first coupling mechanism (32, 32') into engagement with said second coupling mechanism (34, 34'), wherein said winch mechanism (18) is mounted on said yoke (10).

13. An assembly for mooring a first vessel (2) at sea to a second vessel (1) comprising, a yoke (10') selectively disconnectably coupled between said first vessel (2) and said second vessel (1) and having first and second ends with a non-disconnectable coupling arrangement between said first end and said second vessel (1) and a disconnectable coupling arrangement between said second end and said first vessel, said non-disconnectable coupling arrangement including a pivoted connection between said first end of said yoke and said second vessel that allows said yoke (10') to rotate about a horizontal axis, said second end of said yoke having a buoyant element (28) to cause said second end of said yoke (10') not to sink when said second end of said yoke rotates about said horizontal axis into the sea, said disconnectable coupling member including a first coupling member (32') at said second end of said yoke which is arranged and designed with a second coupling member (34') carried by said first vessel (2), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), a tension member (20, 110) arranged and designed to extend through said first and second coupling members and to be coupled between a winch mechanism (18, 18', 106) and a connector (42, 42'), said winch mechanism and connector being arranged and designed to pull said first coupling mechanism (32, 32') into engagement with said second coupling mechanism (34, 32'), wherein said first coupling member includes a male guide cone (32') mounted on a multiple axis joint (90) which is attached to said second end of said yoke (10'), and said second coupling member includes a female receiver (32') mounted on an extension (8) of said first vessel (2) and arranged and designed to receive said guide cone (32'), and said multiple axis joint (90) is an elastomeric flex joint in combination with an internal vertical axis yaw bearing.

14. An assembly for mooring a first vessel (2) at sea to a second vessel (1) comprising, a yoke (10') selectively disconnectably coupled between said first vessel (2) and said second vessel (1) and having first and second ends with a non-disconnectable coupling arrangement between said first end and said second vessel (1) and a disconnectable coupling arrangement between said second end and said first vessel, said non-disconnectable coupling arrangement including a pivoted connection between said first end of said yoke and said second vessel that allows said yoke (10') to rotate about a horizontal axis, said second end of said yoke having a buoyant element (28) to cause said second end of said yoke (10') not to sink when said second end of said yoke rotates about said horizontal axis into the sea, said disconnectable coupling member including a first coupling member (32') at said second end of said yoke which is arranged and designed with a second coupling member (32') carried by said first vessel (2), a selectively operated locking mechanism (80) arranged and designed between said first and second coupling members (32, 34) to lock said yoke (10) to said vessel (2), thereby mooring said vessel (2) to said body (1) or to unlock said yoke (10) from said vessel (2) thereby allowing said tension member (20, 110) to be uncoupled from said connector (42) for disconnecting said yoke (10) from said vessel (1), a tension member (20, 110) arranged and designed to extend through said first and second coupling members and to be coupled between a winch mechanism (18, 18', 106) and a connector (42, 42'), said winch mechanism and connector being arranged and designed to pull said first coupling mechanism (32, 32') into engagement with said second coupling mechanism (34, 32'), wherein said first coupling member includes a male guide cone (32') mounted on a multiple axis joint (90) which is attached to said second end of said yoke (10'), and said second coupling member includes a female receiver (32') mounted on an extension (8) of said first vessel (2) and arranged and designed to receive said guide cone (32'), and said multiple axis joint (90) is a two-axis gimbaled joint in combination with an internal vertical axis yaw bearing (91).

* * * * *